US007120268B2

(12) United States Patent
Murozaki et al.

(10) Patent No.: US 7,120,268 B2
(45) Date of Patent: Oct. 10, 2006

(54) HEADPHONE

(75) Inventors: Katsunori Murozaki, Chiba (JP); Koji Nageno, Tokyo (JP)

(73) Assignee: Sony Corporation, Tokyo (JP)

( * ) Notice: Subject to any disclaimer, the term of this patent is extended or adjusted under 35 U.S.C. 154(b) by 358 days.

(21) Appl. No.: 10/250,394

(22) PCT Filed: Oct. 31, 2002

(86) PCT No.: PCT/JP02/11392

§ 371 (c)(1),
(2), (4) Date: Jun. 30, 2003

(87) PCT Pub. No.: WO03/039190

PCT Pub. Date: May 8, 2003

(65) Prior Publication Data

US 2004/0170294 A1 Sep. 2, 2004

(30) Foreign Application Priority Data

Oct. 31, 2001 (JP) ..... 2001-335502

(51) Int. Cl.
*H04R 25/00* (2006.01)

(52) U.S. Cl. ..... 381/381; 381/370

(58) Field of Classification Search ..... 381/182, 381/330, 370, 374, 376, 379, 385–386, 381, 381/390

See application file for complete search history.

(56) References Cited

U.S. PATENT DOCUMENTS 4,972,468 A * 11/1990 Murase et al. ..... 379/430
5,412,736 A * 5/1995 Keliiliki ..... 381/381
5,519,782 A * 5/1996 Shinohara et al. ..... 381/370
5,625,171 A * 4/1997 Marshall ..... 181/130
5,729,615 A * 3/1998 Yang ..... 381/370
5,761,298 A * 6/1998 Davis et al. ..... 379/430
6,363,158 B1 * 3/2002 Lu ..... 381/381
6,377,697 B1 * 4/2002 Cheng ..... 381/381
6,396,935 B1 * 5/2002 Makkonen ..... 381/334
6,449,374 B1 * 9/2002 Skulley et al. ..... 381/381
6,775,390 B1 * 8/2004 Schmidt et al. ..... 381/371
6,920,228 B1 * 7/2005 Redmer et al. ..... 381/370
2002/0012441 A1 * 1/2002 Matsunaga et al. ..... 381/381
2004/0131220 A1 * 7/2004 Liu ..... 381/375

FOREIGN PATENT DOCUMENTS

JP 95699/1982 1/1984
JP 95309/1988 2/1990

* cited by examiner

*Primary Examiner*—Curtis Kuntz
*Assistant Examiner*—Phylesha Dabney
(74) *Attorney, Agent, or Firm*—Wolf Greenfield & Sacks

(57) ABSTRACT

In order to obtain an ear-hook headphone that is light and comfortable to wear, a supporting portion that supports a housing portion is provided in the vicinity of one end of an approximately U-shaped bend of an arm-shaped guide portion; a pushing portion that resiliently pushes from behind the auricle of a user toward the housing portion is provided in the vicinity of the other end; and a sound-outputting surface of the housing portion is disposed on the face side of the listener wearing the headphone to be approximately perpendicular to the surface formed by the bend of the arm-shaped guide portion. According to this construction, the housing portion can be easily accommodated in the earhole of the user's ear with the guide portion being slipped along the base of the user's ear, and the headphone can be reliably worn with the pushing portion resiliently pushing from behind his/her auricle.

10 Claims, 15 Drawing Sheets

HEADPHONE

TECHNICAL FIELD

The present invention relates to headphones which, for example, reproduce audio signals.

BACKGROUND ART

Conventionally, there have been headband-type headphones in which a housing that incorporates a speaker unit is fixed by a supporting body on both ends of a horseshoe headband. With respect to headphones of this type, the headband is worn on the head of a user and sound is emitted toward earholes from diaphragms of the speaker units within the housings, thereby reproducing audio signals.

Also, with respect to an ear-hook headphone shown in FIG. 1, for example, a left unit 141 is worn in such a manner that the unit is hung on an ear 142 and sound is emitted toward an earhole from a diaphragm of the speaker unit within the housing, thereby reproducing audio signals. In addition, as this applicant's prior patent there are headphones which have been registered as Japan Patent Office Publication of Examined Applications, Examined Patent Publication No. 6-59120.

However, due to the fact that the above-mentioned headband-type headphones must be worn on the user's head, there has been inconvenience of giving unpleasant sensation to the user, such as applying weight to the user's head and affecting user's hairstyle.

Further, with respect to the ear-hook headphone shown in FIG. 1, since the force of the left unit 141 falling down by its own weight is applied to the upper end of the auricle of the ear 142, a load f on an arm base 143 becomes large, thereby providing inconvenience of unpleasant sensation when wearing the headphone.

DISCLOSURE OF INVENTION

The object of the present invention is to provide ear-hook headphones which are light in weight and improved in wearability.

A first aspect of the present invention is, in a headphone provided with a housing portion in which an electro-acoustic transducer is provided and an arm-shaped guide portion which supports the above-mentioned housing portion, the headphone in which the arm-shaped guide portion has an approximately U-shaped bend, a supporting portion, which supports the housing portion, provided in the vicinity of one end of the bend, and a pushing portion, which resiliently pushes from behind the auricle of a listener toward the housing portion, provided in the vicinity of the other end of the bend; and a sound-outputting surface of the housing portion is disposed on the face side of the listener wearing the headphone to be approximately perpendicular to the surface formed by the bend of the arm-shaped guide portion.

According to the above construction, by a user the housing portion can be easily accommodated in the earhole of the listener's ear as the guide portion is slipped along the base of the listener's ear, and at that time the headphone can be reliably worn with the pushing portion resiliently pushing from behind the auricle of the listener; moreover, the vertically disposed sound-outputting surface causes most of the sound from the electro-acoustic transducer to reach the listener's eardrum directly and makes it possible to obtain excellent sound quality relatively unaffected by the shapes of an auditory meatus and the periphery of an entrance thereof that vary from person to person, and also the headphone can be worn without being affected by the size of auricles, whereby the headphone is comfortably worn and quality of sound listened to can be improved.

A second aspect of the present invention is the headphone according to the first aspect of the present invention, in which a diaphragm provided in the electro-acoustic transducer within the housing is also disposed to be approximately perpendicular to the surface formed by the bend of the arm-shaped guide portion, and the sound emitted by the vibration of the diaphragm is output from the sound-outputting surface.

According to the above construction, since the diaphragm is vertically disposed, most of the sound from the diaphragm is directly output from the sound-outputting surface to reach the eardrum directly, thereby further excellent sound quality being obtained.

A third aspect of the present invention is the headphone according to the first aspect of the present invention, in which a projecting handle is provided at an end of the supporting portion, which supports the housing portion, of the arm-shaped guide portion.

According to the above construction, the user can easily accommodate the housing portion in the earhole of the listener's ear by holding the handle and passing the guide portion along the base of the user's ear, thereby wearing the headphone easily.

A fourth aspect of the present invention is the headphone according to the first aspect of the present invention, in which a handle projected approximately linearly is provided at an end of the supporting portion, which supports the housing portion, of the arm-shaped guide portion, and the approximately linear handle is disposed at a predetermined angle formed with an extended axis of the arm-shaped guide portion.

According to the above construction, when the headphone is worn on the ear of the user, the approximately linear handle opens outward, thereby being disposed in a handy position.

A fifth aspect of the present invention is the headphone according to the first aspect of the present invention, in which a curved guide portion is provided at an end of the pushing portion of the arm-shaped guide portion.

According to the above construction, the user can easily move the curved guide portion along the base of the listener's ear on the back of the user's auricle, thereby wearing the headphone easily.

A sixth aspect of the present invention is the headphone according to the first aspect of the present invention, in which the center of the housing portion is deviated from the axis of the arm-shaped guide portion so that the housing becomes asymmetrical.

According to the above construction, the larger part of the asymmetrical housing portion is accommodated in the earhole of the user's ear, thereby the headphone being worn easily by the user.

A seventh aspect of the present invention is the headphone according to the first aspect of the present invention, in which the center of the housing portion is placed on the axis of the arm-shaped guide portion so that the housing becomes symmetrical.

According to the above construction, both the left and right parts of the housing are uniformly constructed, thereby the housing being constructed easily.

An eighth aspect of the present invention is the headphone according to the first aspect of the present invention, in which a projecting handle is provided at an end of the supporting portion, which supports the housing portion, of the arm-shaped guide portion and a cord which supplies electric signals to the electro-acoustic transducer is pulled out from an end of the handle.

According to the above construction, the code is handled easily and freely by the user.

A ninth aspect of the present invention is the headphone according to the first aspect of the present invention, in which openings which emit sound from the sound-outputting surface of the housing portion are only provided on the sound-outputting surface at positions close to the earhole of the listener wearing the headphone and no other openings for emitting sound are provided thereon at positions away from the earhole.

According to the above construction, it becomes possible to prevent sound from leaking to the outside and also sound is easily listened to by the user.

A tenth aspect of the present invention is the headphone according to the first aspect of the present invention, in which the arm-shaped guide portion and the housing portion are integrally formed.

According to the above construction, by integrally forming those portions, the construction of headphone is simplified and the cost is reduced.

An eleventh aspect of the present invention is the headphone according to the first aspect of the present invention, in which a projecting handle is provided at an end of the supporting portion, which supports the housing portion, of the arm-shaped guide portion, and a cord which supplies electric signals to the electro-acoustic transducer is pulled out from the handle with a cord stopper provided therein.

According to the above construction, the cord is fixed within the handle to prevent the cord from being severed.

BRIEF DESCRIPTION OF DRAWINGS

FIG. 4A shows the attachment in an asymmetrical manner, FIG. 4B shows that in a symmetrical manner, FIG. 4C shows that in an asymmetrical and slanting manner, and FIG. 4D shows that in a symmetrical and slanting manner, respectively;

FIG. 5A shows the attachment in an asymmetrical manner, FIG. 5B shows that in a symmetrical manner, FIG. 5C shows that in an asymmetrical and slanting manner, and FIG. 5D shows that in a symmetrical and slanting manner, respectively;

FIG. 11A is of an user with small ears, FIG. 11B is of a user with large ears, FIG. 11C is of a user with earholes facing downward and FIG. 11D is of a user with earholes facing upward, respectively;

BEST MODE FOR CARRYING OUT THE INVENTION

Hereinafter, an embodiment of the present invention will be described.

According to a headphone of this embodiment, the shapes of the guide portion and the pushing portion make it possible to wear the housing portion easily and reliably, whereby there can be obtained sound of excellent quality relatively unaffected by the shape of an auditory meatus and the periphery of an entrance thereof that vary from person to person.

Figure 1:
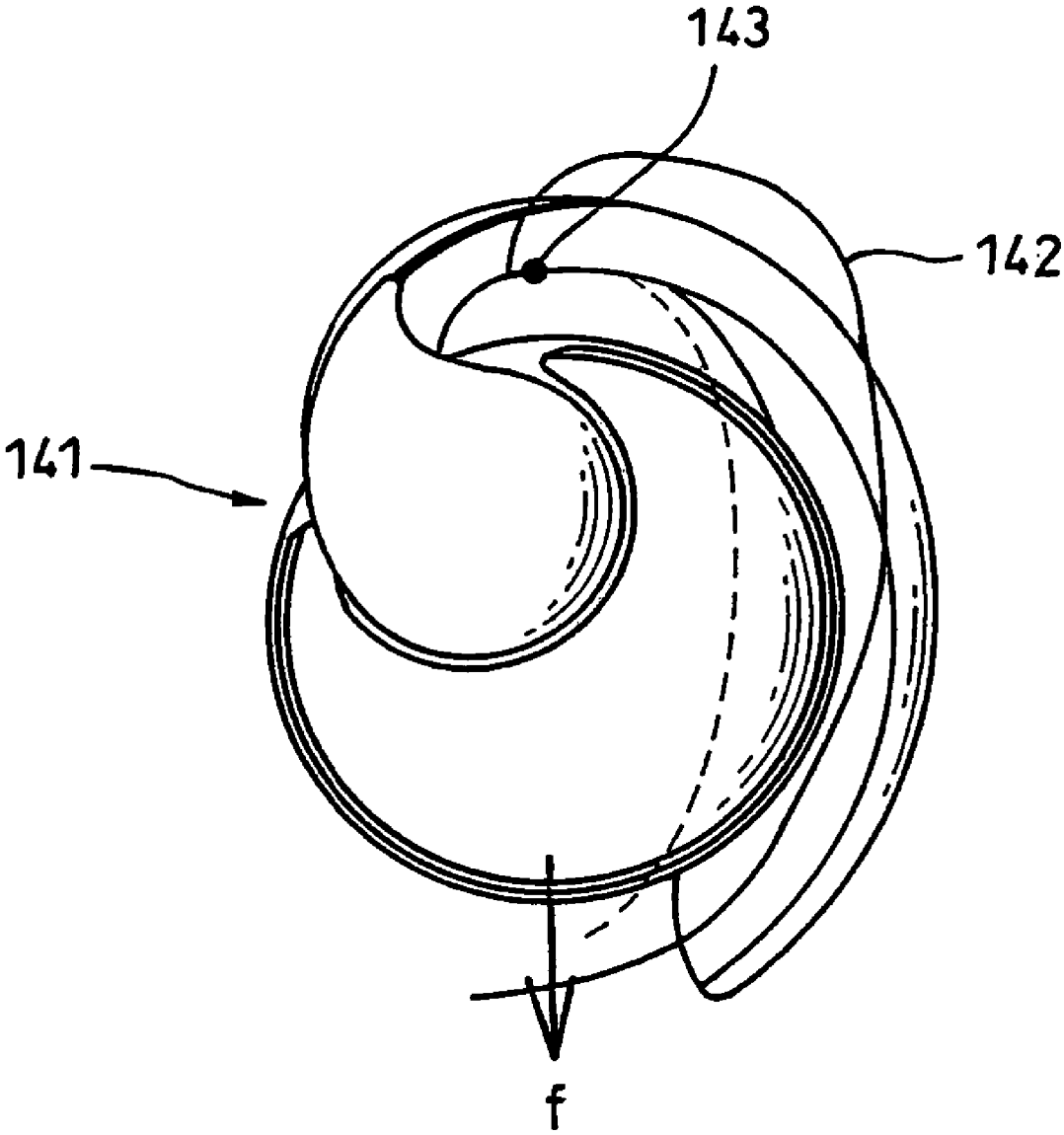
FIG. 1 is a view showing a conventional ear-hook headphone.
Figure 2:
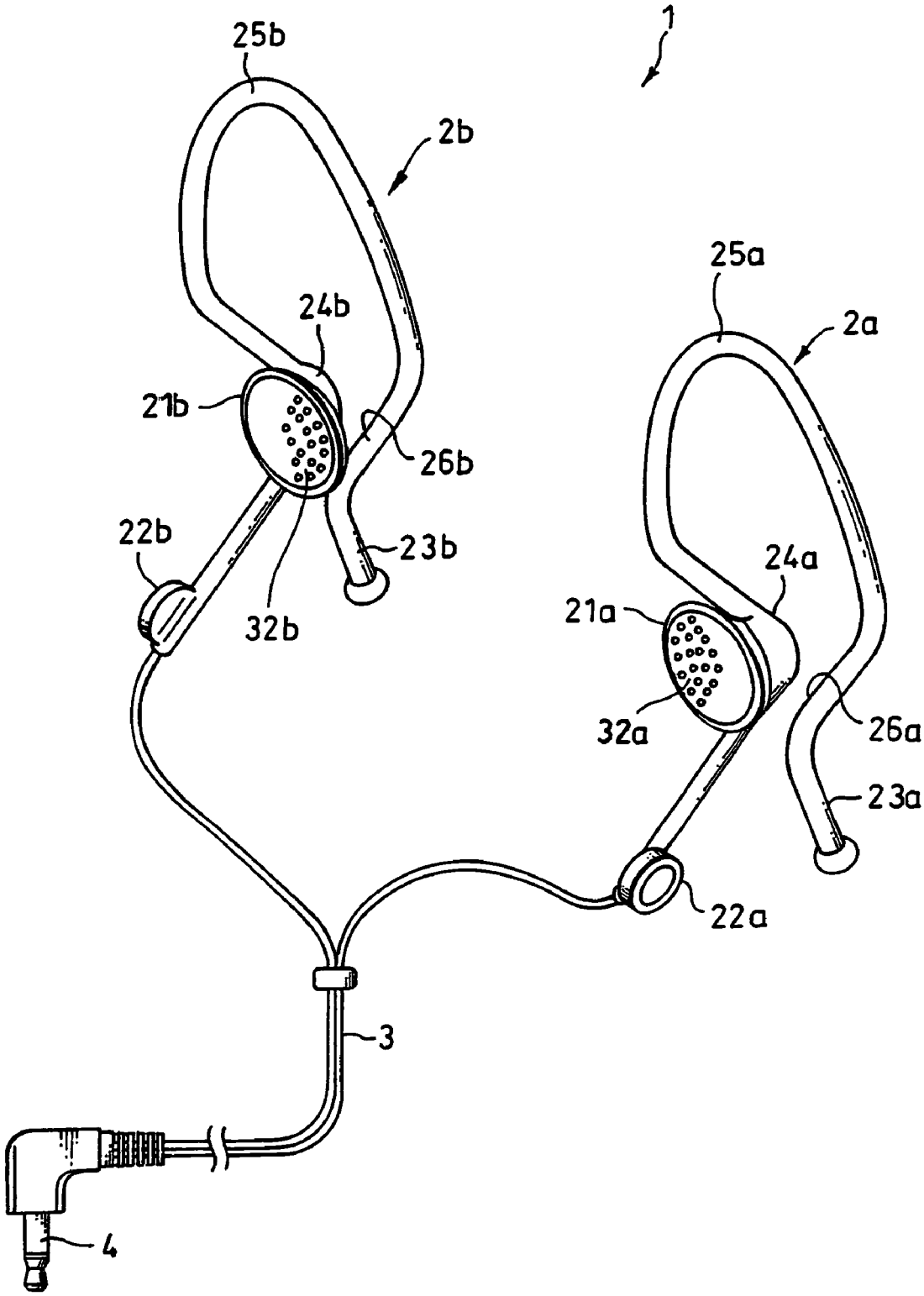
FIG. 2 is a perspective view showing the external appearance of headphones according to an embodiment of the present invention.

FIG. 2 is a view showing the external appearance of headphones applied to this embodiment. As shown in FIG. 2, headphones 1 comprise: a left unit 2*a* which is worn on the left ear of the user, a right unit 2*b* which is worn on the right ear of the user, cords 3 which supply electric signals to electromotive electro-acoustic transducers incorporated in the left unit 2*a* and right unit 2*b*, and a plug 4 capable of attaching the cords 3 to an outside source of electric signals in a detachable manner.

The left unit 2*a* and right unit 2*b* of the headphones 1 are each constructed with a housing portion in which an electromotive electro-acoustic transducer is provided, and an arm-shaped guide portion which supports the housing portion.

In the left unit 2*a* of the headphones 1, an arm-shaped guide portion 23*a* has an approximately U-shaped bend 25*a*, and is provided with: a supporting portion 24*a* that supports a housing portion 21*a* in the vicinity of one end of the bend 25*a*, and a pushing portion 26*a* that resiliently pushes from behind the auricle of the user toward the housing portion 21*a* in the vicinity of the other end of the bend 25*a*; and a diaphragm (not shown in the figure) of the housing portion 21*a* is disposed on the face side of the user wearing the headphones 1 to be approximately perpendicular to the surface formed by the bend 25*a* of the arm-shaped guide portion 23*a*. Sound emitted from the diaphragm within the housing portion 21*a* is output to the outside from a sound-outputting surface of the housing portion 21*a*. The sound-outputting surface is circular and approximately flat (in fact slightly curved) in shape, and is disposed on the face side of the user wearing the headphones 1, similarly to the diaphragm. On this sound-outputting surface, openings 32*a* which are described later are provided in a predetermined condition.

Further, in the right unit 2*b* of the headphones 1, an arm-shaped guide portion 23*b* has an approximately U-shaped bend 25*b*, and is provided with: a supporting portion 24*b* that supports a housing portion 21*b* in the vicinity of one end of the bend 25*b*, and a pushing portion 26*b* that resiliently pushes from behind the auricle of the user toward the housing portion 21*b* in the vicinity of the other end of the bend 25*b*; and a diaphragm of the housing portion 21*b* is disposed on the face side of the user wearing the headphones 1 to be approximately perpendicular to the surface formed by the bend 25*b* of the arm-shaped guide portion 23*b*. Sound emitted from the diaphragm within the housing portion 21*b* is output to the outside from a sound-outputting surface of the housing portion 21*b*. This sound-outputting surface is circular and almost flat (in fact slightly curved) in shape, and is disposed on the face side of the user wearing the headphones 1, similarly to the diaphragm. On this sound-outputting surface, openings 32*b* that are described later are provided in a predetermined condition.

Further, in the headphones 1, projecting handles 22*a* and 22*b* are provided at the ends of the supporting portions 24*a* and 24*b*, which support the housing portions 21*a* and 21*b*, of the arm-shaped guide portions 23*a* and 23*b*, respectively.

Further, in the headphones 1, curved guide portions 23*a* and 23*b* are provided at the ends of the pushing portions 26*a* and 26*b* of the arm-shaped guide portions 23*a* and 23*b*, respectively.

Further, in the headphones 1, the center of the housing portions 21*a* and 21*b* are deviated from the axes of the arm-shaped guide portions 23*a* and 23*b* so that the housing portions 21*a* and 21*b* are asymmetrical.

Further, in the headphones 1, the center of the housing portions 21*a* and 21*b* are placed on the axes of the arm-shaped guide portions 23*a* and 23*b*, respectively so that the housing portions 21*a* and 21*b* are symmetrical, respectively. Also, in the headphones 1, projecting handles 22*a* and 22*b* are provided at the ends of the supporting portions 24*a* and 24*b*, which support the housing portions 21*a* and 21*b*, of the arm-shaped guide portions 23*a* and 23*b*, respectively, and cords 3 which supply electric signals to the electro-acoustic transducers are pulled out from the handles 22*a* land 22*b*, respectively.

Furthermore, in the headphones 1, a number of openings 32*a* and 32*b* which are minute through-holes that emit sound from the diaphragms of the housing portions 21*a* and 21*b* are provided on the earhole sides of the user wearing the headphones. Although these openings 32*a* and 32*b*, which are through-holes, may be uniformly disposed on the sound-outputting surfaces, in this embodiment the openings are disposed only on the side close to the head of the user wearing the headphones, as shown in FIG. 2.

Furthermore, in the headphones 1, the arm-shaped guide portions 23*a* and 23*b* and the housing portions 21*a* and 21*b* are integrally formed, respectively.

Furthermore, in the headphones 1, projecting handles 22*a* and 22*b* are provided at the ends of the supporting portions 24*a* and 24*b*, which support the housing portions 21*a* and 21*b*, of the arm-shaped guide portions 23*a* and 23*b*, respectively, and cords 3 which supply electric signals to the electro-acoustic transducers are pulled out from the handles 22*a* and 22*b* with cord stoppers being provided in the handles 22*a* and 22*b*, respectively.

Figure 3:
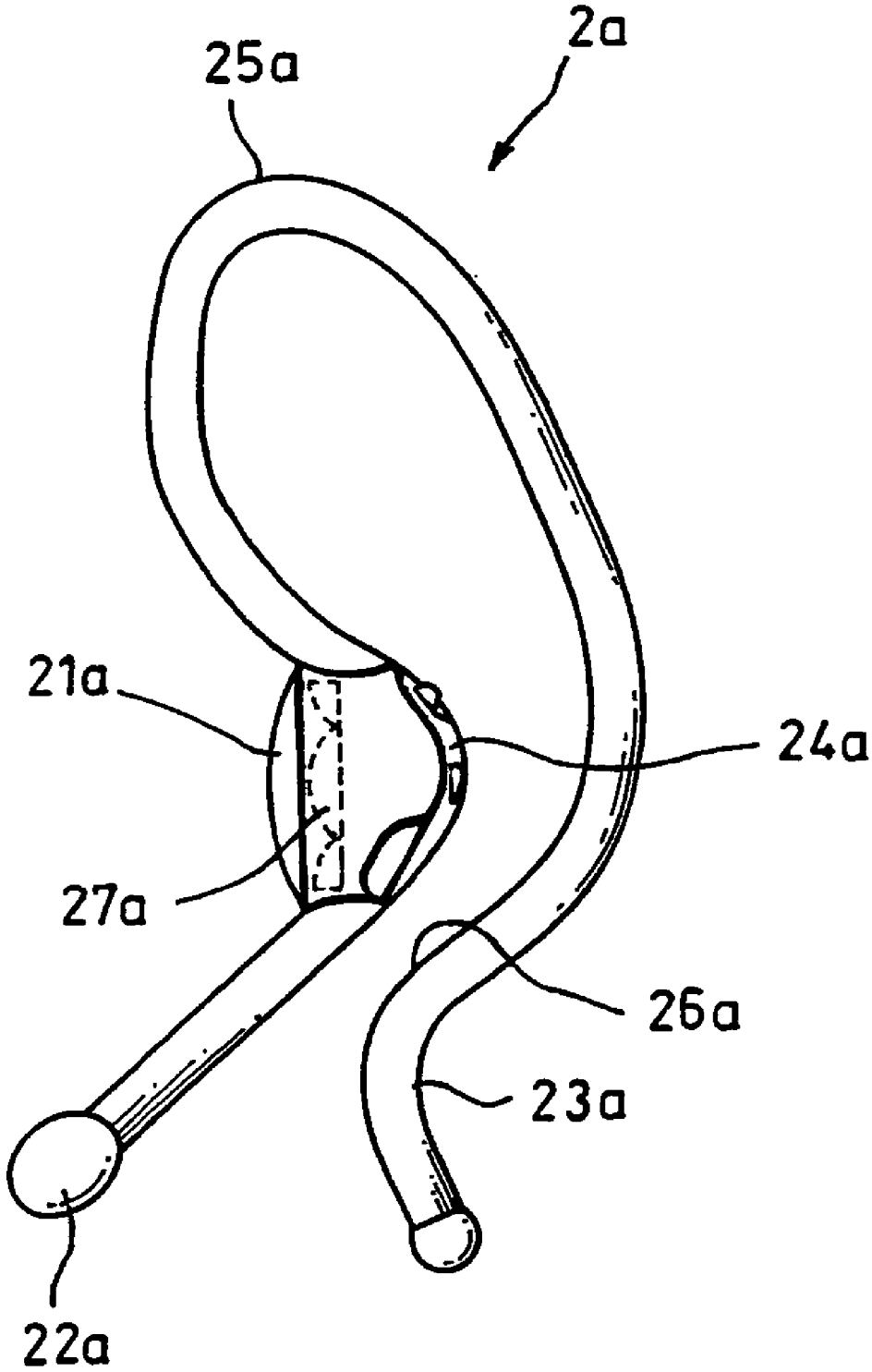
FIG. 3 is a side view showing the construction of a headphone according to an embodiment of the present invention.

FIG. 3 is a view showing the construction of the headphone. Although FIG. 3 only shows the left unit 2*a* shown in FIG. 2, since the right unit 2*b* is constructed symmetrically, illustration and description in detail with respect to the right unit 2*b* will be omitted. FIG. 3 shows the outside of the left unit 2*a* shown in FIG. 2, that is, the side opposite to the inside facing the user's ear.

As shown in FIG. 3, in the left unit 2*a* the arm-shaped guide portion 23*a* is constructed to include the approximately U-shaped bend 25*a* at the top, which has such space as can cover the base of the upper end of the user's auricle. Also, with respect to the arm-shaped guide portion 23*a*, the supporting portion 24*a* which conically supports the semi-conical housing portion 21*a* is provided on the left front in the vicinity of one end of the bend 25*a*.

Also, the arm-shaped guide portion 23*a* is provided in the vicinity of the other end of the bend 25*a* with the pushing portion 26*a* which resiliently pushes from behind the auricle of the user toward the conical supporting portion 24*a* of the housing portion 21*a* while being worn on the user.

The position of the housing portion 21*a* can be fixed by gently holding the auricle between this pushing portion 26*a* and the conical supporting portion 24*a* of the housing portion 21*a*.

This bend 25*a* is formed of a size suitable for a large ear and has extra space when worn on a small ear, so that length adjustment is unnecessary. Further, an arched portion extending from the bend 25*a* to the pushing portion 26*a* is constructed to fit the back of the auricle, so that the bend 25*a* can be prevented from lifting.

Also, with respect to the arm-shaped guide portion 23*a*, a diaphragm 27*a* within the housing portion 21*a* is constructed such that the diaphragm 27*a* is disposed on the face side of the user wearing the arm-shaped guide portion 23*a*, namely on the left-hand side in FIG. 3, to be approximately perpendicular to the surface formed by the bend 25*a* of the arm-shaped guide portion 23*a*, as shown in FIG. 3.

Further, the projecting handle 22*a* which extends to the face side of the user is provided at the end of the supporting portion 24*a*,which supports the housing portion 21*a*, of the arm-shaped guide portion 23*a*. The projecting handle 22*a* extends to the face side of the user, thereby being held easily by the user's fingers.

Further, the curved guide portion 23*a* which extends to the opposite side to the user's face is provided at the end of the pushing portion 26*a* of the arm-shaped guide portion 23*a*.

Since this handle 22*a* and the guide portion 23*a* extend in opposite directions to each other, the left unit 2*a* can be easily led to the back of the auricle and thus easily worn.

FIGS. 4A to 4D are front views each showing a manner in which the housing portion and the guide portion are attached. FIGS. 4A to 4D only show the left unit 2*a* shown in FIG. 2 and illustration and explanation in detail with respect to the right unit 2*b* will be omitted on the grounds that the right unit 2*b* and the left unit 2*a* are constructed symmetrically. FIGS. 4A to 4D are views each showing the front side of the left unit 2*a* that is shown in FIG. 2*a*, namely the face side of the user.

Figure 4A:
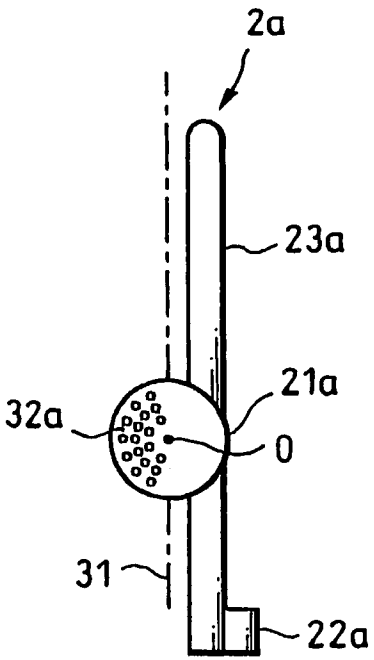
FIGS. 4A to 4D are front views each showing a manner in which a housing portion and a guide portion of a headphone according to an embodiment of the present invention are attached.

FIG. 4A is a view showing a manner in which the housing portion and the guide portion are attached asymmetrically.

In the left unit 2*a* of the headphones 1 shown in FIG. 4A, the center line 31 of the center O of the housing portion 21*a* is deviated from the axis of the arm-shaped guide portion 23*a* so that the housing portion 21*a* is asymmetrical. In addition, the handle 22*a* is constructed to extend along the arm-shaped guide portion 23*a*, and the center line 31 of the center O of the housing portion 21*a* is also deviated from the axis of the handle 22*a* so that the housing portion 21*a* is asymmetrical. Also, the openings 32*a* which emit sound from the diaphragm of the housing portion 21*a* are provided on the earhole side of the user wearing the left unit 2*a*.

Figure 4B:
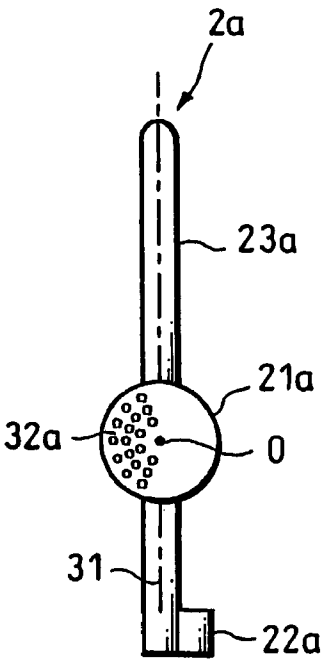

FIG. 4B is a view showing a manner in which the housing portion and the guide portion are attached symmetrically.

In the left unit 2*a* of the headphones 1 shown in FIG. 4B, the center line 31 of the center O of the housing portion 21*a* is placed on the axis of the arm-shaped guide portion 23*a* so that the housing portion 21*a* is symmetrical. In addition, the handle 22*a* is constructed to extend along the arm-shaped guide portion 23*a*, and the center line 31 of the center O of the housing portion 21*a* is also placed on the axis of the handle 22*a* so that the housing portion 21*a* is symmetrical. Also, the openings 32*a* which emit sound from the diaphragm of the housing portion 21*a* are provided on the earhole side of the user wearing the left unit 2*a*. Accordingly, sound from the diaphragm of the housing portion 21*a* is emitted from the openings 32*a* to the portion accommodated in the auditory canal.

Figure 4C:
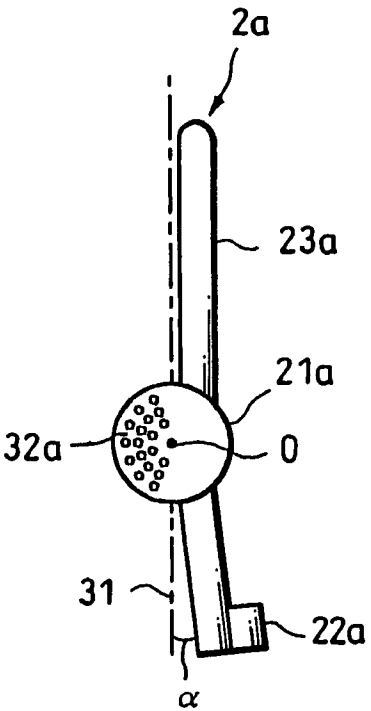

FIG. 4C is a view showing a manner in which the housing portion and the guide portion are attached asymmetrically and obliquely.

In the left unit 2*a* of the headphones 1 shown in FIG. 4C, the center line 31 of the center O of the housing portion 21*a* is deviated from the axis of the arm-shaped guide portion 23*a* so that the housing portion 21*a* is asymmetrical. In addition, the handle 22*a* is constructed to extend along the arm-shaped guide portion 23*a*, and the center line 31 of the center O of the housing portion 21*a* is also deviated from the axis of the handle 22*a* so that the housing portion 21*a* is asymmetrical and the handle 22*a* is made to have an angle with respect to the center line 31 of the center O of the housing portion 21*a* on the opposite side to the user's earhole. Also, the openings 32*a* which emit sound from the diaphragm of the housing portion 21*a* are provided on the earhole side of the user wearing the left unit 2*a*.

Figure 4D:
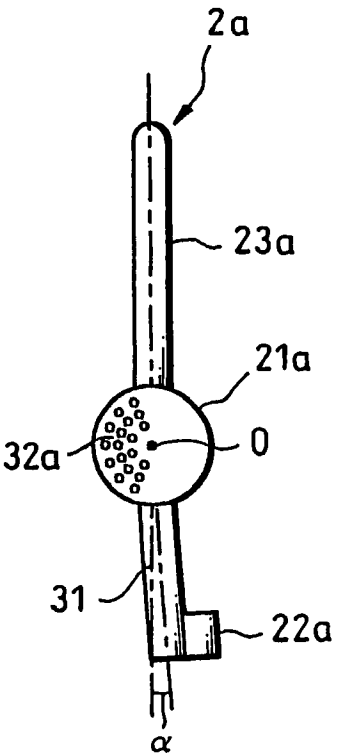

FIG. 4D is a view showing a manner in which the housing portion and the guide portion are attached symmetrically and obliquely.

In the left unit 2*a* of the headphones 1 shown in FIG. 4D, the center line 31 of the center O of the housing portion 21*a* is placed on the axis of the arm-shaped guide portion 23*a* so that the housing portion 21*a* is symmetrical. In addition, the handle 22*a* is constructed to extend along the arm-shaped guide portion 23*a*, and the center line 31 of the center O of the housing portion 21*a* is also placed on the axis of the handle 22*a* so that the housing portion 21*a* is symmetrical, and the handle 22*a* is made to have an angle with respect to the center line 31 of the center O of the housing portion 21*a* on the opposite side to the user's earhole. Also, the openings 32*a* which emit sound from the diaphragm of the housing portion 21*a* are provided on the earhole side of the user wearing the left unit 2*a*.

FIGS. 5A to 5D are bottom plan views each showing a manner in which the housing portion and the guide portion are attached. FIGS. 5A to 5D only show the left unit 2*a* shown in FIG. 2 and illustration and explanation in detail with respect to the right unit 2*b* will be omitted on the grounds that the right unit 2*b* and the left unit 2*a* are constructed symmetrically. FIGS. 5A to 5D are views each showing the bottom side of the left unit 2*a* shown in FIG. 2, namely the lower end side of the user's ear. The upper side of the FIGS. 5 is the earhole side of the user.

Figure 5A:
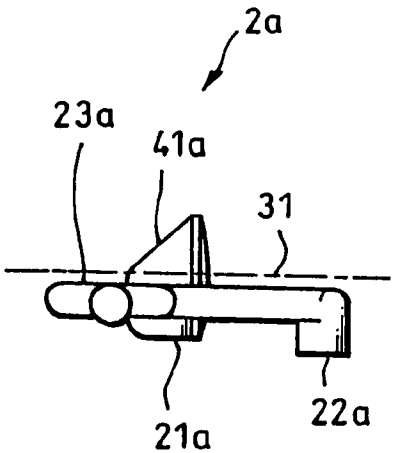
FIGS. 5A to 5D are bottom plan views each showing a manner in which a housing portion and a guide portion of a headphone according to an embodiment of the present invention are attached.

FIG. 5A is a view showing a manner in which the housing portion and the guide portion are attached asymmetrically.

In the left unit 2*a* of the headphones 1 shown in FIG. 5A, the center line 31 of the housing portion 21*a* is deviated from the axis of the arm-shaped guide portion 23*a* so that the housing portion 21*a* is asymmetrical. In addition, the handle 22*a* is constructed to extend along the arm-shaped guide portion 23*a*, and the center line 31 of the center O of the housing portion 21*a* is also deviated from the axis of the handle 22*a* so that the housing portion 21*a* is asymmetrical. Also, the user's earhole side of the housing portion 21*a*, which is the opposite side to the openings that emit sound from the diaphragm, is constructed to be a slanting surface 41*a*.

Figure 5B:
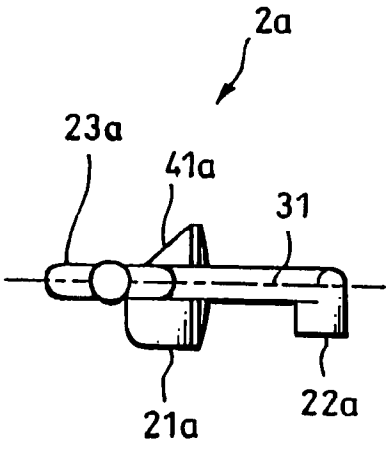

FIG. 5B is a view showing a manner in which the housing portion and the guide portion are attached symmetrically.

In the left unit 2*a* of the headphones 1 shown in FIG. 5B, the center line 31 of the housing portion 21*a* is placed on the axis of the arm-shaped guide portion 23*a* so that the housing portion 21*a* is symmetrical. In addition, the handle 22*a* is constructed to extend along the arm-shaped guide portion 23*a*, and the center line 31 of the housing portion 21*a* is also placed on the axis of the handle 22*a* so that the housing portion 21*a* is symmetrical. Also, the user's earhole side of the housing portion 21*a*, which is the opposite side to the openings that emit sound from the diaphragm, is constructed to be a slanting surface 41*a*.

Figure 5C:
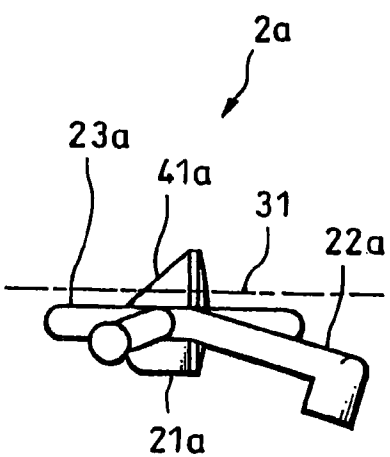

FIG. 5C is a view showing a manner in which the housing portion and the guide portion are attached asymmetrically and obliquely.

In the left unit 2*a* of the headphones 1 shown in FIG. 5C, the center line 31 of the housing portion 21*a* is deviated from the axis of the arm-shaped guide portion 23*a* so that the housing portion 21*a* is asymmetrical. In addition, the handle 22*a* is constructed to extend along the arm-shaped guide portion 23*a*, and the center line 31 of the housing portion 21*a* is also deviated from the axis of the handle 22*a* so that the housing portion 21*a* is asymmetrical and the handle 22*a* is made to have an oblique angle with respect to the center line 31 of the housing portion 21*a* on the opposite side to the user's earhole. Also, the user's earhole side of the housing portion 21*a*, which is the opposite side to the openings that emit sound from the diaphragm, is constructed to be a slanting surface 41*a*.

Figure 5D:
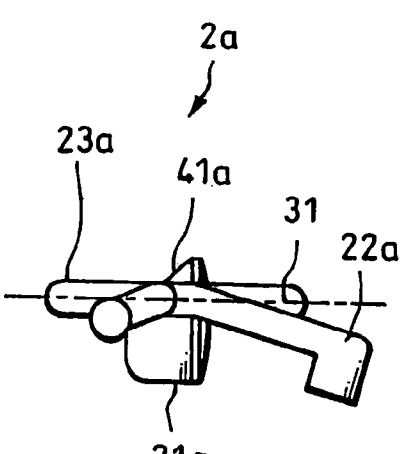

FIG. 5D is a view showing a manner in which the housing portion and the guide portion are attached symmetrically and obliquely.

Figure 6:
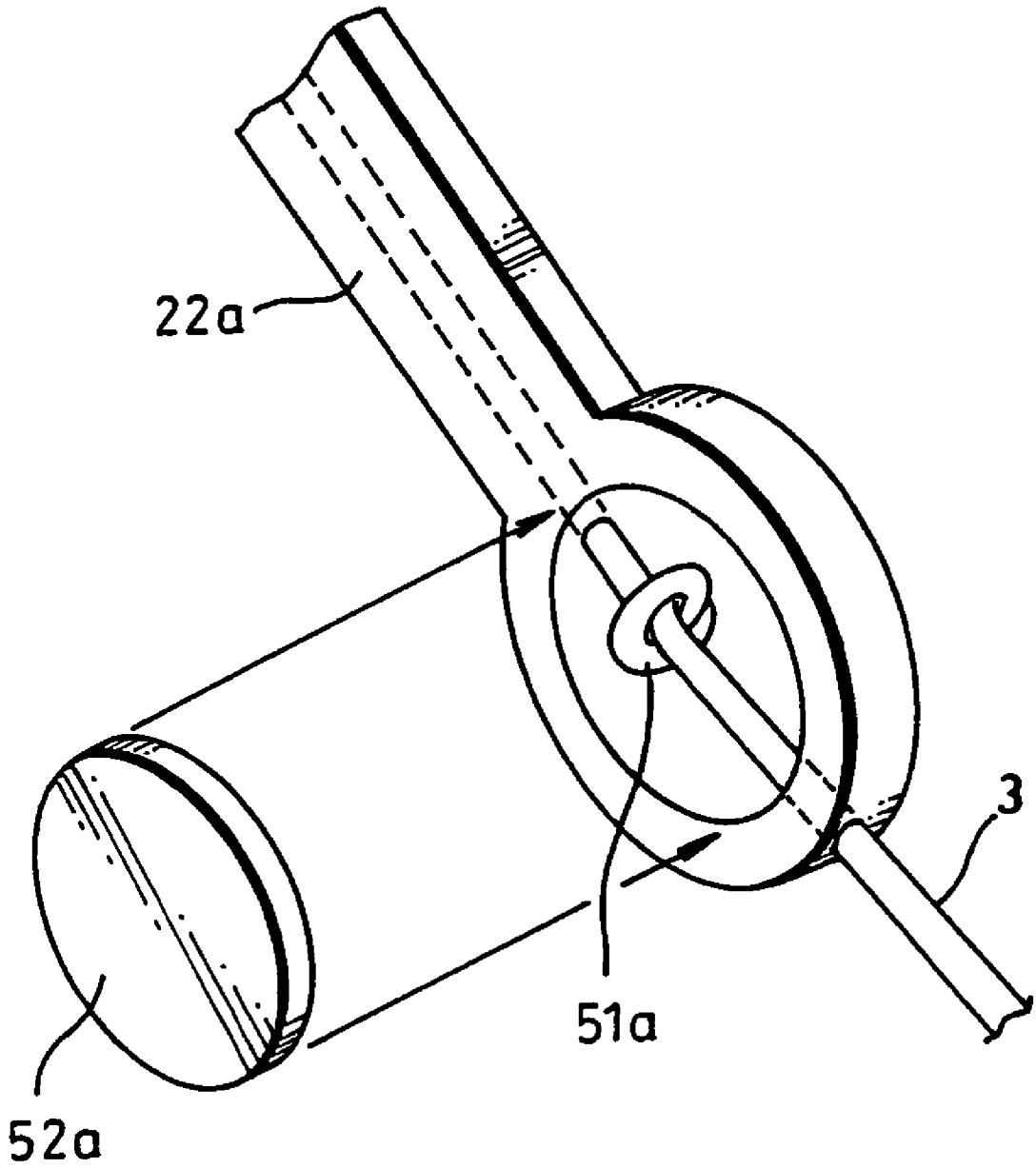
FIG. 6 is a view showing the inside of a handle of a headphone according to an embodiment of the present invention.

In the left unit 2*a* of the headphones 1 shown in FIG. 5D, the center line 31 of the housing portion 21*a* is placed on the axis of the arm-shaped guide portion 23*a* so that the housing portion 21*a* is symmetrical. In addition, the handle 22*a* is constructed to extend along the arm-shaped guide portion 23*a*, and the center line 31 of the housing portion 21*a* is also placed on the axis of the handle 22*a* so that the housing portion 21*a* is symmetrical, and the handle 22*a* is made to have an oblique angle with respect to the center line 31 of the housing portion 21*a* on the opposite side to the user's earhole. Also, the user's earhole side of the housing portion 21*a*, which is the opposite side to the openings that emit sound from the diaphragm, is constructed to be a slanting surface 41*a*. 0052 FIG. 6 is a view showing the inside of the handle. FIG. 6 only shows the left unit 2*a* shown in FIG. 2 and illustration and explanation in detail with respect to the right unit 2*b* will be omitted on the grounds that the right unit 2*b* and the left unit 2*a* are constructed symmetrically.

In the left unit 2*a* of the headphones 1 shown in FIG. 6, the projecting handle 22*a* is provided at an end of the supporting portion 24*a,* which supports the housing portion 21*a,* of the arm-shaped guide portion 23*a;* the cord 3 which supplies electric signals to the electro-acoustic transducer is pulled out from the handle 22*a;* a knot 51*a* that serves as the cord stopper is provided within the handle 22*a;* and a cap 52*a* covers the knot 51*a.*

Figure 7:
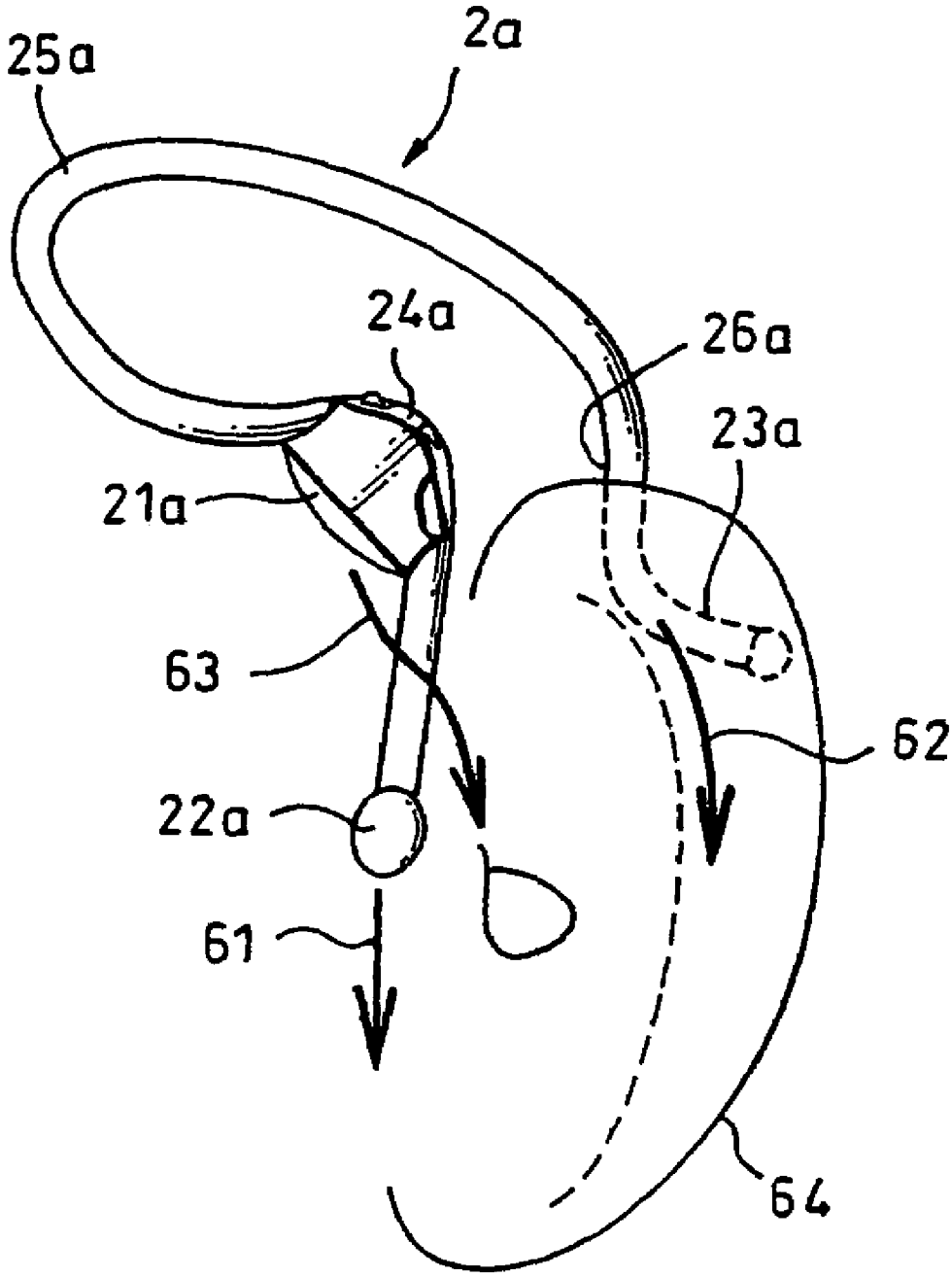
FIG. 7 is an explanatory view showing a manner in which a headphone according to an embodiment of the present invention is worn.

FIG. 7 is a view showing a manner of wearing the headphone. FIG. 7 only shows the left unit 2*a* shown in FIG. 2 and illustration and explanation in detail with respect to the right unit 2*b* will be omitted on the grounds that the right unit 2*b* and the left unit 2*a* are constructed symmetrically. FIG. 7 is a view showing the outside of the left unit 2*a* shown in FIG. 2, namely the side that is opposite to the inside facing the user's ear.

First, with respect to the left unit 2*a* shown in FIG. 7, while the curved guide portion 23*a,* which is provided at the end of the pushing portion 26*a* of the arm-shaped guide portion 23*a* and extends to the opposite side to the face of the user, is set on the upper end of an ear 64 of a user 71, the projecting handle 22*a* that is provided at the end of the supporting portion 24*a,* which supports the housing portion 21*a,* of arm-shaped guide portion 23*a* and extends to the face side of the user, is pulled downward as shown with an arrow 61.

Next, the curved guide portion 23*a,* which is provided at an end of the pushing portion 26*a* of the arm-shaped guide portion 23*a* and extends to the opposite side to the user's face, is moved along the base of the user's ear 64 as shown with an arrow 62.

Then the semi-conical housing portion 21*a,* which is provided in the left front in the vicinity of one end of the bend 25*a* of the arm-shaped guide portion 23*a* in such a manner that the semi-conical housing portion 21*a* is conically supported by the supporting portion 24*a,* is accommodated in the earhole of the user's ear 64 as shown with an arrow 63.

On this occasion, the approximately U-shaped bend 25*a* provided at the top of the arm-shaped guide portion 23*a* is constructed to have such space as can cover the base of the upper end of the auricle of the user's ear 64.

Also, on this occasion, the pushing portion 26*a,* which is provided in the vicinity of the other end of the bend 25*a* of the arm-shaped guide portion 23*a,* resiliently pushes from behind the auricle of the user toward the conical supporting portion 24*a* of the housing portion 21*a* while being worn on the user.

The position of the housing portion 21*a* can be fixed by gently holding the auricle between this pushing portion 26*a* and the conical supporting portion 24*a* of the housing portion 21*a.*

Also, on this occasion, with respect to the arm-shaped guide portion 23*a,* the diaphragm within the housing portion 21*a* is disposed on the face side of the user wearing the arm-shaped guide portion 23*a* to be approximately perpendicular to the surface formed by the bend 25*a* of the arm-shaped guide portion 23*a* of FIG. 7, namely the left-hand side in FIG. 7.

This bend 25*a* is formed of a size suitable for a large ear and has extra space when worn on a small ear, so that length adjustment is unnecessary. Further, an arched portion extending from the bend 25*a* to the pushing portion 26*a* is constructed to fit the back of the auricle, so that the bend 25*a* can be prevented from lifting.

Further, the projecting handle 22*a* which extends to the face side of the user is provided at an end of the supporting portion 24*a,* which supports the housing portion 21*a,* of the arm-shaped guide portion 23*a,* and the handle 22*a* projects and extends to the face side of the user, thereby being held easily by the user's fingers.

Further, the curved guide portion 23*a* extending to the opposite side to the user's face is provided at the end of the pushing portion 26*a* of the arm-shaped guide portion 23*a,* whereby this handle 22*a* and the guide portion 23*a* extend in opposite directions to each other and the left unit 2*a* can be easily led to the back of the auricle and thus easily worn.

Hereinafter, the procedure for wearing headphones according to the embodiment will be explained in sequence.

Figure 8:
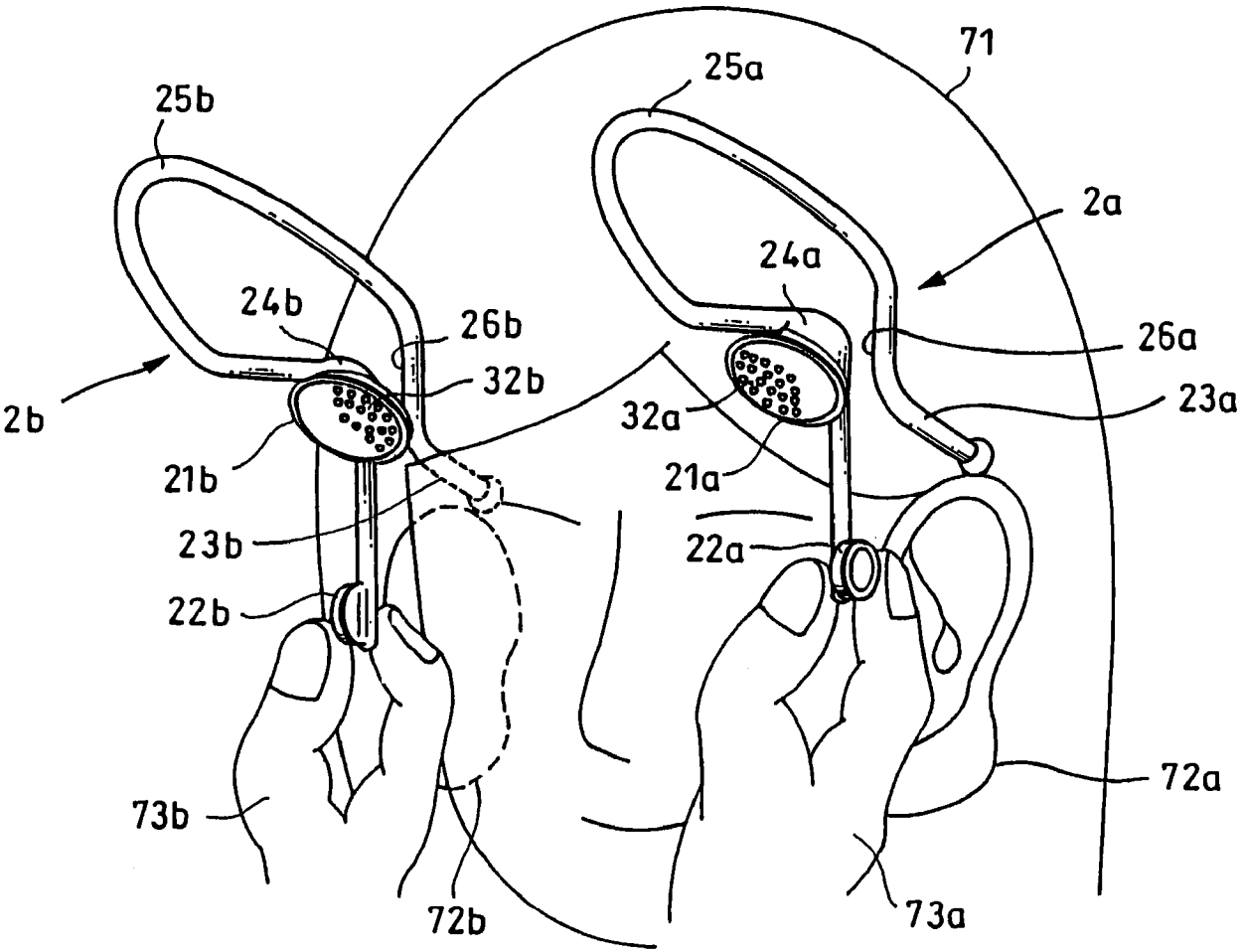
FIG. 8 is an explanatory view showing an example of the state in which headphones according to an embodiment of the present invention start to be worn.

FIG. 8 is a view showing the state in which headphones start to be worn.

As shown in FIG. 8, in the state in which the left and right units 2*a* and 2*b* start to be worn, first, while the curved guide portions 23*a* and 23*b,* which are provided at the ends of the pushing portions 26*a* and 26*b* of the arm-shaped guide portions 23*a* and 23*b* and extend to the opposite side to the user's face, are set on the upper ends of the user 71's ears 72*a* and 72*b,* the projecting handles 22*a* and 22*b* provided at the ends of the supporting portions 24*a* and 24*b,* which support the housing portions 21*a* and 21*b,* of the arm-shaped guide portions 23*a* and 23*b* and extend to the face side of the user 71, are pulled downward with the fingers 73*a* and 73*b.*

Figure 9:
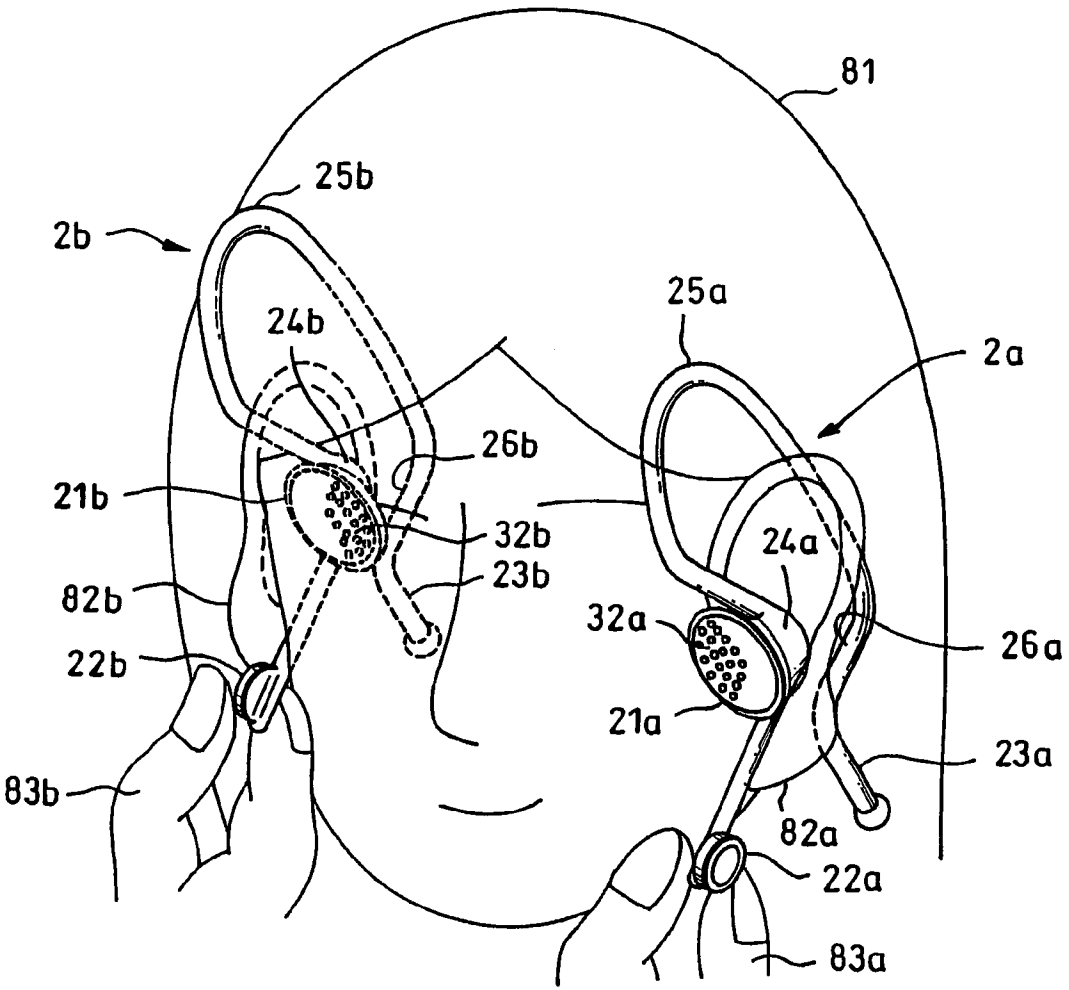
FIG. 9 is an explanatory view showing the state in which headphones according to an embodiment of the present invention are in the middle of being worn.

FIG. 9 is a view showing the state in which headphones are in the middle of being worn.

As shown in FIG. 9, in the state in which the left and right units 2*a* and 2*b* are in the middle of being worn, by turning with the fingers 73*a* and 73*b* the projecting handles 22*a* and 22*b* that are provided at the ends of the supporting portions 24*a* and 24*b,* which support the housing portions 21*a* and 21*b,* of the arm-shaped guide portions 23*a* and 23*b* and extend to the face side of the user 71, the curved guide portions 23*a* and 23*b,* which are provided at the ends of the pushing portions 26*a* and 26*b* of the arm-shaped guide portions 23*a* and 23*b* and extend to the opposite side to the user's face, are moved such that the curved guide portions 23*a* and 23*b* are slipped along the bases of a user 81's ears 82*a* and 82*b.*

Figure 10:
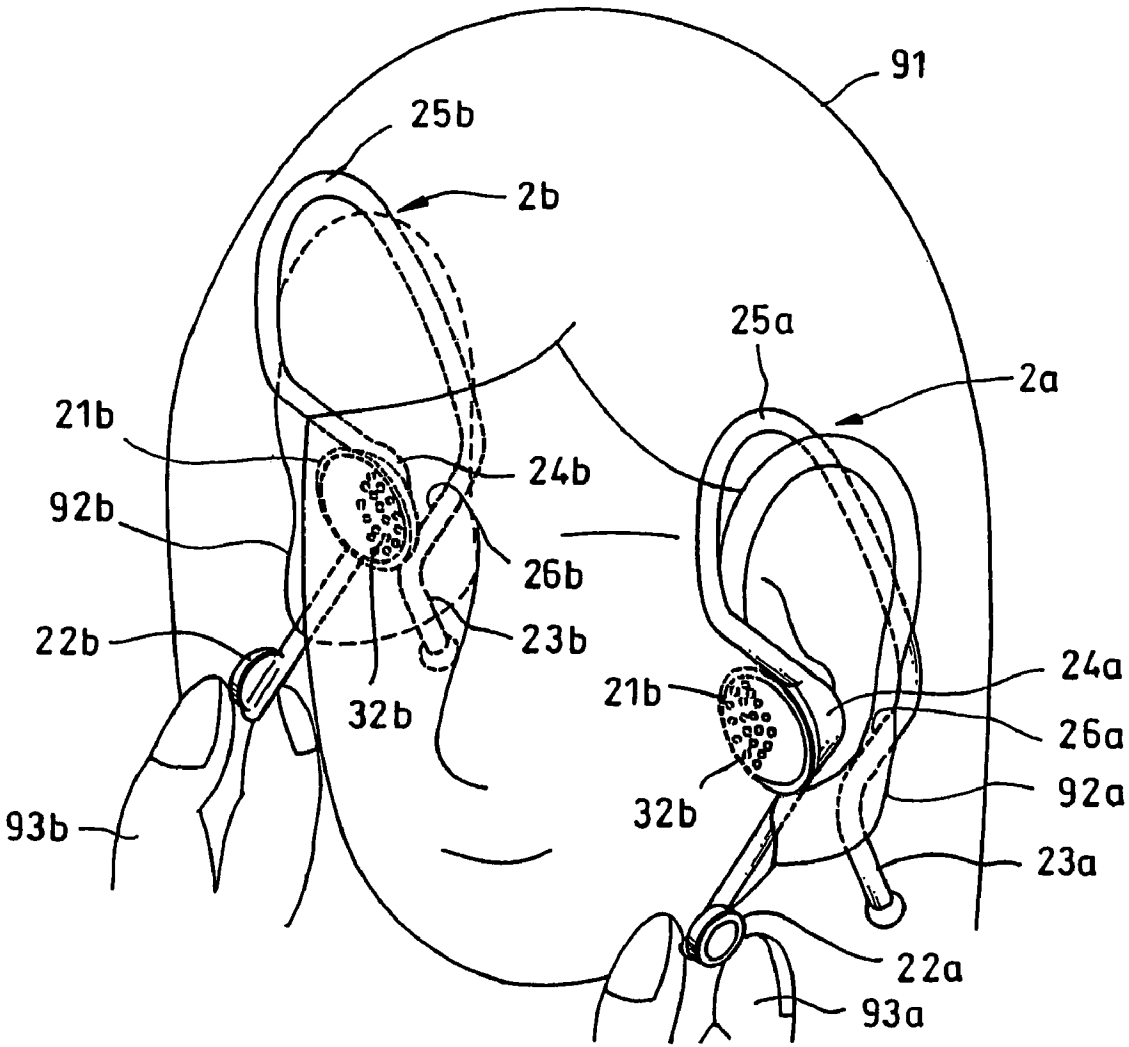
FIG. 10 is an explanatory view showing the state in which headphones according to an embodiment of the present invention are completely worn.

FIG. 10 is a view showing the state in which headphones are completely worn.

As shown in FIG. 10, in the state in which the left and right units 2*a* and 2*b* are completely worn, the openings 32*a* and 32*b* of the semi-conical housing portions 21*a* and 21*b* which is provided in the left front in the vicinity of one ends of the bends 25*a* and 25*b* of the arm-shaped guide portions 23*a* and 23*b* and conically supported by the supporting portions 24*a* and 24*b* are accommodated in the earholes of the user 91's ears 92*a* and 92*b.*

On this occasion, the approximately U-shaped bends 25*a* and 25*b* provided at the tops of the arm-shaped guide portions 23*a* and 23*b* are worn such that the bends have such space as can cover the bases of the upper ends of the auricles of the user 91's ears 92*a* and 92*b.*

Also, on this occasion, the pushing portions 26*a* and 26*b,* which are provided in the vicinity of the other ends of the bends 25*a* and 25*b* of the arm-shaped guide portions 23*a* and 23*b,* resiliently push from behind the auricles of the user 91 toward the conical supporting portions 24*a* and 24*b* of the housing portions 21*a* and 21*b* while being worn on the user 91.

Also, on this occasion, with respect to the arm-shaped guide portions 23*a* and 23*b,* the diaphragms within the housing portions 21*a* and 21*b* are disposed on the face side of the viewer wearing the arm-shaped guide portions 23*a* and 23*b* to be approximately perpendicular to the surfaces formed by the bends 25*a* and 25*b* of the arm-shaped guide portions 23*a* and 23*b*.

The positions of the housing portions 21*a* and 21*b* can be fixed by gently holding the auricles between these pushing portions 26*a* and 26*b* and the conical supporting portions 24*a* and 24*b* of the housing portions 21*a* and 21*b*.

These bends 25*a* and 25*b* are formed of a size suitable for large ears and have extra space when worn on small ears, so that length adjustment is unnecessary. Further, arched portions extending from the bends 25*a* and 25*b* to the pushing portions 26*a* and 26*b* are constructed to fit the back of the auricles, so that the bends 25*a* and 25*b* can be prevented from lifting.

Further, the projecting handles 22*a* and 22*b* which extend to the face side of the user are provided at the ends of the supporting portions 24*a* and 24*b*, which support the housing portions 21*a* and 21*b*, of the arm-shaped guide portions 23*a* and 23*b*, and the handles 22*a* and 22*b* project and extend to the face side of the user, thereby being held easily by the user's fingers.

Further, the curved guide portions 23*a* and 23*b* extending to the opposite side to the user's face are provided at the ends of the pushing portions 26*a* and 26*b* of the arm-shaped guide portions 23*a* and 23*b*, whereby the handles 22*a* and 22*b* and the guide portions 23*a* and 23*b* extend in opposite directions to each other and the right and left unit 2*a* and 2*b* can be easily led to the back of the auricles and thus easily worn.

FIGS. 11A to 11D are views each showing a state in which the headphone is worn.

Figure 11A:
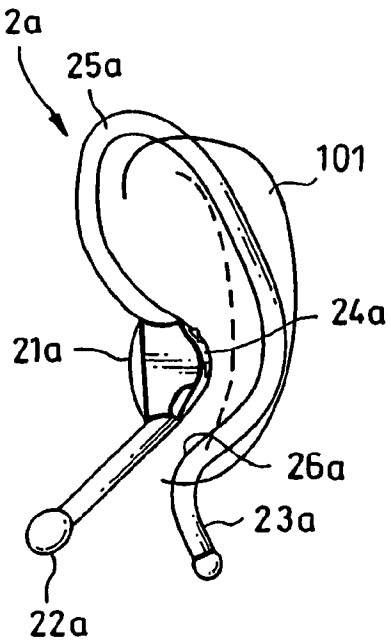
FIGS. 11A to 11D are side views each showing a state in which a headphone according to an embodiment of the present invention is worn.

FIG. 11A is a case of a user with small ears.

As shown in FIG. 11A, in the state in which the left unit 2*a* is being worn, the semi-conical housing portion 21*a* which is provided in the left front in the vicinity of one end of the bend 25*a* of the arm-shaped guide portion 23*a* and supported conically by the supporting portion 24*a* is accommodated in the earhole of the user's small ear 101.

On this occasion, the approximately U-shaped bend 25*a* provided at the top of the arm-shaped guide portion 23*a* is worn such that the bend has such space as can cover the upper end of the auricle of the user's small ear 101. On this occasion, the bend 25*a* is worn with the top end protruding from the upper end of the auricle of the user's small ear 101.

Also, on this occasion, the pushing portion 26*a*, which is provided in the vicinity of the other end of the bend 25*a* of the arm-shaped guide portion 23*a*, resiliently pushes from behind the auricle of the user's small ear 101 toward the conical supporting portion 24*a* of the housing portion 21*a* while being worn on the user.

On this occasion, the front of the earhole entrance (what is called intertragica) of the user's small ear 101 is held by the portion between the conical supporting portion 24*a* of the housing portion 21*a* and the handle 22*a*. Then, the pushing portion 26*a* is set on the back of the lower part of the auricle of the user's small ear 101. In addition, the portion between the bend 25*a* of the arm-shaped guide portion 23*a* and the pushing portion 26*a* thereof is set on the back of the auricle of the user's ear 101.

Further, on this occasion, with respect to the arm-shaped guide portion 23*a*, the diaphragm within the housing portion 21*a* is disposed on the face side of the user wearing the arm-shaped guide portion 23*a* to be approximately perpendicular to the surface formed by the bend 25*a* of the arm-shaped guide portion 23*a*.

Figure 11B:
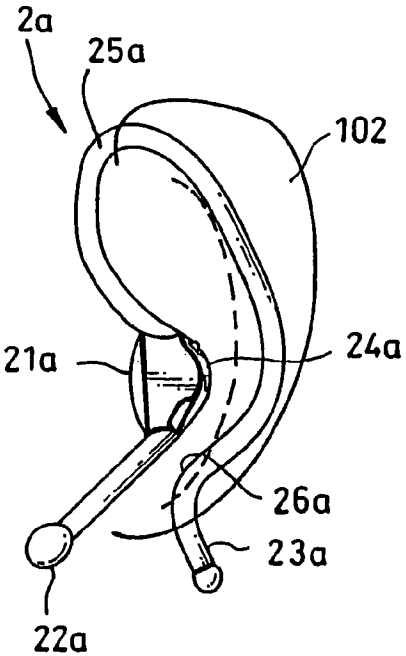

FIG. 11B is a case of a user with large ears.

As shown in FIG. 11B, in the state in which the left unit 2*a* is being worn, the semi-conical housing portion 21*a* which is provided in the left front in the vicinity of one end of the bend 25*a* of the arm-shaped guide portion 23*a* and conically supported by the supporting portion 24*a* is accommodated in the earhole of the user's large ear 102.

On this occasion, the approximately U-shaped bend 25*a* provided at the top of the arm-shaped guide portion 23*a* is worn such that the bend has such space as can cover the base of the upper end of the auricle of the user's large ear 102. On this occasion, the bend 25*a* is worn with the top end being accommodated in the upper end of the auricle of the user's large ear 102.

Also, on this occasion, the pushing portion 26*a*, which is provided in the vicinity of the other end of the bend 25*a* of the arm-shaped guide portion 23*a*, resiliently pushes from behind the auricle of the user's large ear 102 toward the conical supporting portion 24*a* of the housing portion 21*a* while being worn on the user.

On this occasion, the front of the earhole entrance of the user's large ear 102 is held by the portion between the conical supporting portion 24*a* of the housing portion 21*a* and the handle 22*a*. Then, the pushing portion 26*a* is set on the back of the auricle of the user's large ear 102. In addition, the portion between the bend 25*a* of the arm-shaped guide portion 23*a* and the pushing portion 26*a* thereof is set on the back of the auricle of the user's ear 102.

Also, on this occasion, with respect to the arm-shaped guide portion 23*a*, the diaphragm within the housing portion 21*a* is disposed on the face side of the user wearing the left unit 2*a* to be approximately perpendicular to the surface formed by the bend 25*a* of the arm-shaped guide portion 23*a*.

Figure 11C:
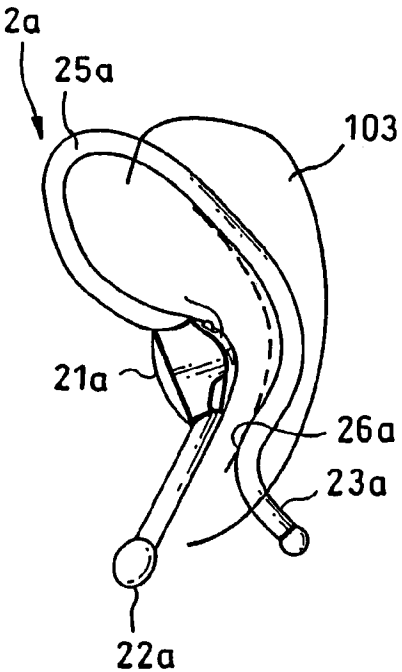

FIG. 11C is a case of a user with earholes facing downward.

As shown in FIG. 11C, in the state in which the left unit 2*a* is being worn, the semi-conical housing portion 21*a*, which is provided in the left front in the vicinity of one end of the bend 25*a* of the arm-shaped guide portion 23*a* and conically supported by the supporting portion 24*a*, is accommodated in the downward-facing earhole of the user's ear 103.

On this occasion, the approximately U-shaped bend 25*a* provided at the top of the arm-shaped guide portion 23*a* is worn such that the bend has such space as can cover the base of the upper end of the auricle of the user's ear 103. On this occasion, the bend 25*a* is worn with the top end slightly protruding forward from the upper end of the auricle of the user's ear 103.

Also, on this occasion, the pushing portion 26*a*, which is provided in the vicinity of the other end of the bend 25*a* of the arm-shaped guide portion 23*a*, resiliently pushes from behind the auricle of the user's ear 103 toward the conical supporting portion 24*a* of the housing portion 21*a* while being worn on the user.

On this occasion, the front of the earhole entrance of the user's ear 103 is held by the portion between the conical supporting portion 24*a* of the housing portion 21*a* and the handle 22*a*. Then, the pushing portion 26*a* is set on the back of the auricle of the user's ear 103. In addition, the portion between the bend 25*a* of the arm-shaped guide portion 23*a* and the pushing portion 26*a* thereof is set on the back of the auricle of the user's ear 103.

Also, on this occasion, with respect to the arm-shaped guide portion 23*a*, the diaphragm within the housing portion 21*a* is disposed as slightly facing down on the face side of the user wearing the arm-shaped guide portion 23*a* to be approximately perpendicular to the surface formed by the bend 25*a* of the arm-shaped guide portion 23*a*.

Figure 11D:
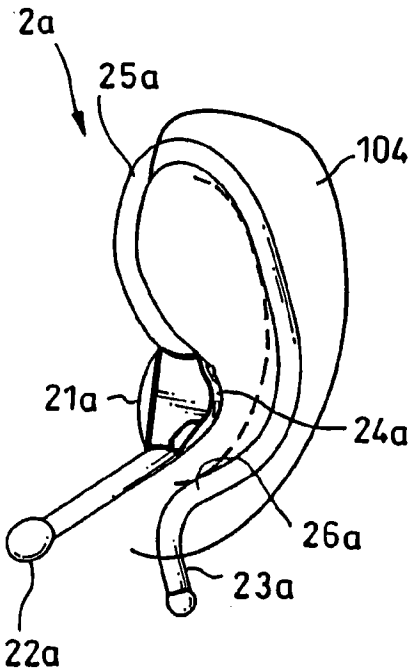

FIG. 11D is a case of a user with earholes facing upward.

As shown in FIG. 11D, in the state in which the left unit 2*a* is being worn, the semi-conical housing portion 21*a* which is provided in the left front in the vicinity of one end of the bend 25*a* of the arm-shaped guide portion 23*a* and conically supported by the supporting portion 24*a* is accommodated in the upward-facing earhole of the user's ear 104.

On this occasion, the approximately U-shaped bend 25*a* provided at the top of the arm-shaped guide portion 23*a* is worn such that the bend has such space as can cover the base of the upper end of the auricle of the user's ear 104. On this occasion, the bend 25*a* is worn with the top end being accommodated in the upper end of the auricle of the user's ear 104.

Also, on this occasion, the pushing portion 26*a,* which is provided in the vicinity of the other end of the bend 25*a* of the arm-shaped guide portion 23*a,* resiliently pushes from behind the auricle of the user's ear 104 toward the conical supporting portion 24*a* of the housing portion 21*a* while being worn on the user. On this occasion, the portion between the conical supporting portion 24*a* of the housing portion 21*a* and the handle 22*a* is held by the intertragic notch of the user's ear 104. Then the pushing portion 26*a* is set on the back of the antitragus of the user's ear 104. In addition, the portion between the bend 25*a* of the arm-shaped guide portion 23*a*and the pushing portion 26*a* thereof is set on the back of the auricle of the user's ear 104.

Also, on this occasion, with respect to the arm-shaped guide portion 23*a,* the diaphragm within the housing portion 21*a* is disposed as slightly facing up on the face side of the user wearing the arm-shaped guide portion 23*a* to be approximately perpendicular to the surface formed by the bend 25*a* of the arm-shaped guide portion 23*a.*

Accordingly, a user can easily accommodate the semi-conical housing portion 21*a* in the earhole of the user's ear by holding the handle 22*a* and slipping the guide portion 23*a* along the base of the user's ear, and at this time, the pushing portion 26*a* resiliently pushes from behind the listener's auricle toward the conical supporting portion 24*a* of the housing portion 21*a,* thereby allowing the user to wear a headphone reliably.

Also, with respect to the size of the user's ear, the headphone can be easily worn on ears of any size without length adjustment by making use of the space of the bend 25*a* of the arm-shaped guide portion 23*a;* also, with respect to the position and the shape of the earhole, the housing portion is easily inserted into earholes of any type regardless of the shape and position thereof by using the semi-conical housing portion 21*a;* moreover, since the user's ear is pushed toward the conical supporting portion 24*a* of the housing portion 21*a* by the pushing portion 26*a,* the position of the semi-conical housing portion 21*a* can be reliably determined with respect to users with earholes in any shape and ears in any size.

Furthermore, with respect to the arm-shaped guide portion 23*a,* the diaphragm within the housing portion 21*a* is disposed as slightly facing up on the face side of the user wearing the arm-shaped guide portion 23*a* to be approximately perpendicular to the surface formed by the bend 25*a* of the arm-shaped guide portion 23*a,* so that most of the sound from the diaphragm reaches the eardrum directly as relatively unaffected by the shapes of an auditory meatus and the periphery of an entrance thereof that vary from person to person; excellent sound quality can be obtained; and the headphone can be worn without being affected by the sizes of auricles.

Consequently, the headphone can be comfortably worn by the user and quality of sound that is listened to can be improved.

Figure 12:
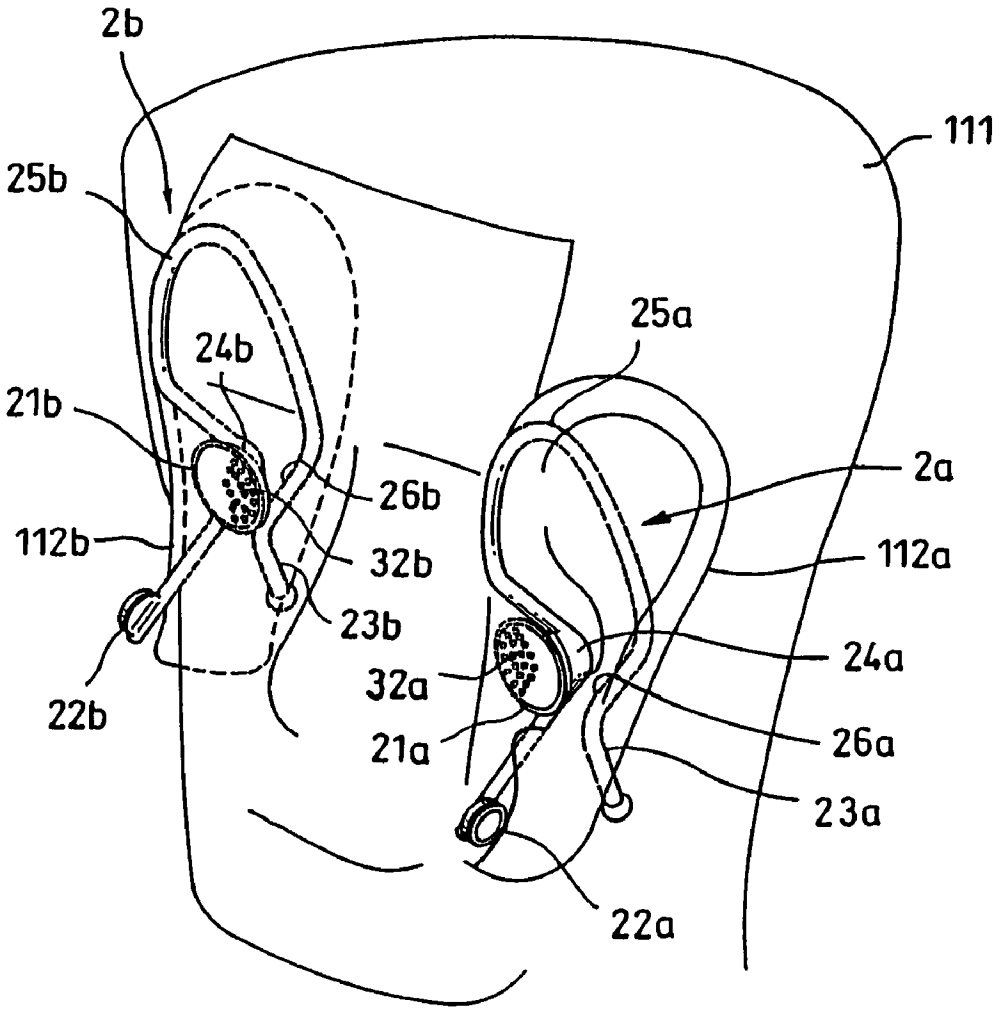
FIG. 12 is an explanatory view showing the state in which headphones according to an embodiment of the present invention are being worn on large-sized ears.

FIG. 12 is a view showing the state in which the headphones are being worn on large ears.

As shown in FIG. 12, in the state in which the left and right units 2*a* and 2*b* are being worn on large ears, the openings 32*a* and 32*b* of the semi-conical housing portions 21*a* and 21*b,* which is provided in the left front in the vicinity of one ends of the bends 25*a* and 25*b* of the arm-shaped guide portions 23*a* and 23*b* and conically supported by the supporting portions 24*a* and 24*b,* are accommodated in the earholes of the user 111's large ears 112*a* and 112*b.*

On this occasion, the approximately U-shaped bends 25*a* and 25*b* provided at the tops of the arm-shaped guide portions 23*a* and 23*b* are worn such that the bends have such space as can cover the bases of the upper ends of the auricles of the user 111's large ears 112*a* and 112*b.* On this occasion, the bends 25*a* and 25*b* are worn with the top ends completely accommodated in the upper ends of the auricles of the user 111's large ears 112*a* and 112*b.*

Also, on this occasion, the pushing portions 26*a* and 26*b,* which are provided in the vicinity of the other ends of the bends 25*a* and 25*b* of the arm-shaped guide portions 23*a* and 23*b,* resiliently push from behind the auricles of the user 111's large ears 112*a* and 112*b* toward the conical supporting portions 24*a* and 24*b* of the housing portions 21*a* and 21*b* while being worn on the user.

On this occasion, the portions between the conical supporting portions 24*a* and 24*b* of the housing portions 21*a* and 21*b,* and the handles 22*a* and 22*b* are held by the intertragic notches of the user's large ears 112*a* and 112*b.* Then, the pushing portions 26*a* and 26*b* are set on the backs of the antitragi of the user's large ears 112*a* and 112*b.* In addition, the portions between the bends 25*a* and 25*b* of the arm-shaped guide portions 23*a* and 23*b* and the pushing portions 26*a* and 26*b* thereof are set on the backs of the auricles of the user's ears 112*a* and 112*b.*

Also, on this occasion, with respect to the arm-shaped guide portions 23*a* and 23*b,* the diaphragms within the housing portions 21*a*and 21*b* are disposed on the face side of the user wearing the arm-shaped guide portions 23*a* and 23*b* to be approximately perpendicular to the surfaces formed by the bends 25*a* and 25*b* of the arm-shaped guide portions 23*a* and 23*b.*

Figure 13:
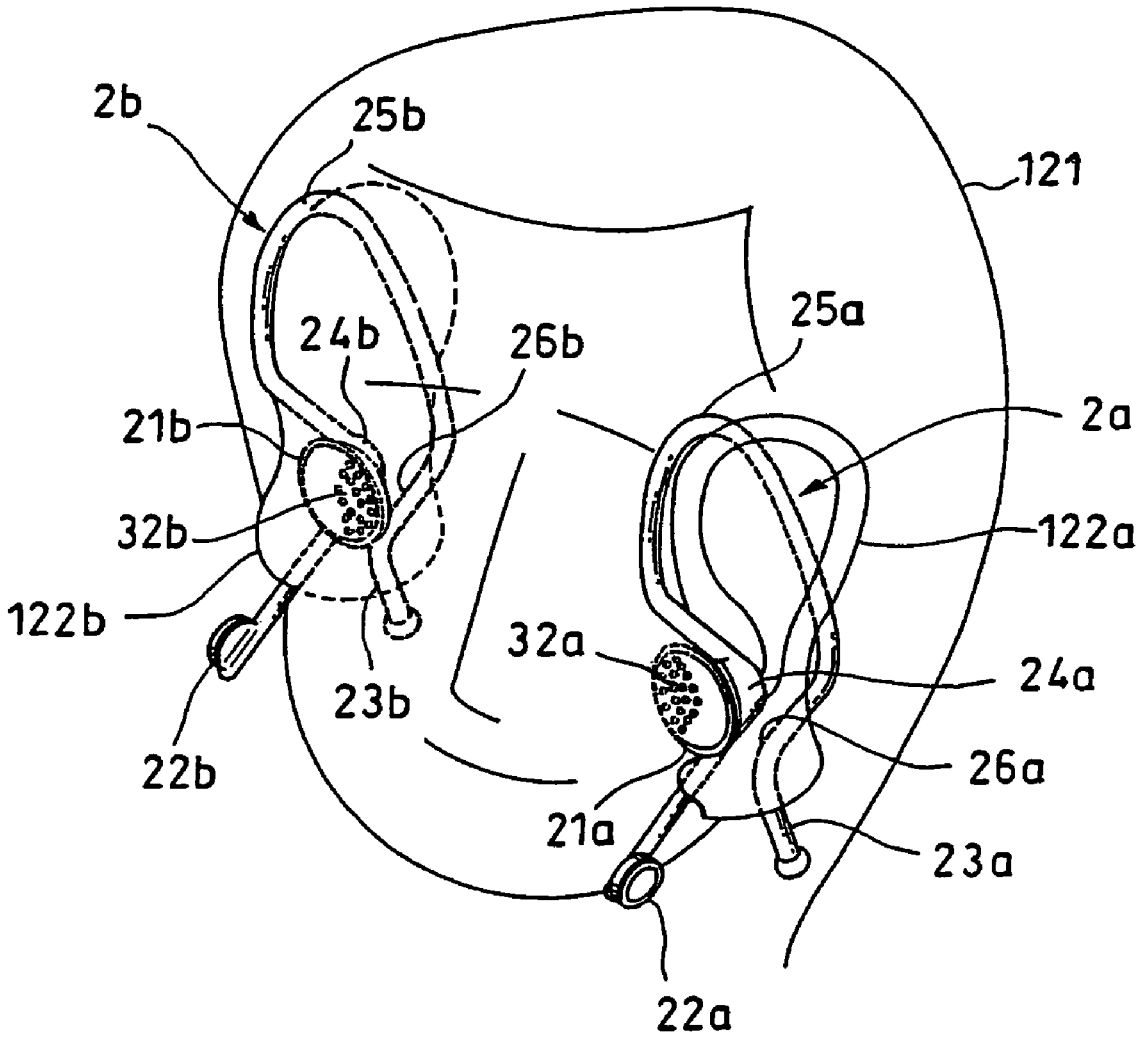
FIG. 13 is an explanatory view showing the state in which headphones according to an embodiment of the present invention are being worn on standard-sized ears.

FIG. 13 is a view showing the state in which the headphones are being worn on standard size ears.

As shown in FIG. 13, in the state in which the left and right units 2*a* and 2*b* are being worn on standard size ears, the openings 32*a* and 32*b* of the semi-conical housing portions 21*a* and 21*b,* which is provided in the left front in the vicinity of one ends of the bends 25*a* and 25*b* of the arm-shaped guide portions 23*a* and 23*b* and conically supported by the supporting portions 24*a* and 24*b,* are accommodated in the earholes of the user 121's standard size ears 122*a* and 122*b.*

On this occasion, the approximately U-shaped bends 25*a* and 25*b* provided at the tops of the arm-shaped guide portions 23*a* and 23*b* are worn such that the bends have such space as can cover the bases of the upper ends of the auricles of the user 121's standard size ears 122*a* and 122*b.* On this occasion, the bends 25*a* and 25*b* are worn with the top ends almost accommodated in the upper ends of the auricles of the user 121's standard size ears 122*a* and 122*b.*

Also, on this occasion, the pushing portions 26*a* and 26*b,* which are provided in the vicinity of the other ends of the bends 25*a* and 25*b* of the arm-shaped guide portions 23*a* and 23*b*, resiliently push from behind the auricles of the user 121's standard size ears 122*a* and 122*b* toward the conical supporting portions 24*a* and 24*b* of the housing portions 21*a* and 21*b* while being worn on the user 121.

On this occasion, the portions between the conical supporting portions 24*a* and 24*b* of the housing portions 21*a* and 21*b*, and the handles 22*a* and 22*b* are held by the front sides of the earhole entrances of the user's standard size ears 122*a* and 122*b*. Then, the pushing portions 26*a* and 26*b* are set on the backs of the auricles of the user's standard size ears 122*a* and 122*b*. In addition, the portions between the bends 25*a* and 25*b* of the arm-shaped guide portions 23*a* and 23*b*, and the pushing portions 26*a* and 26*b* thereof are set on the backs of the auricles of the user's standard size ears 122*a* and 122*b*. Also, on this occasion, with respect to the arm-shaped guide portions 23*a* and 23*b*, the diaphragms within the housing portions 21*a* and 21*b* are disposed on the face side of the user wearing the arm-shaped guide portions 23*a* and 23*b* to be approximately perpendicular to the surfaces formed by the bends 25*a* and 25*b* of the arm-shaped guide portions 23*a* and 23*b*.

Figure 14:
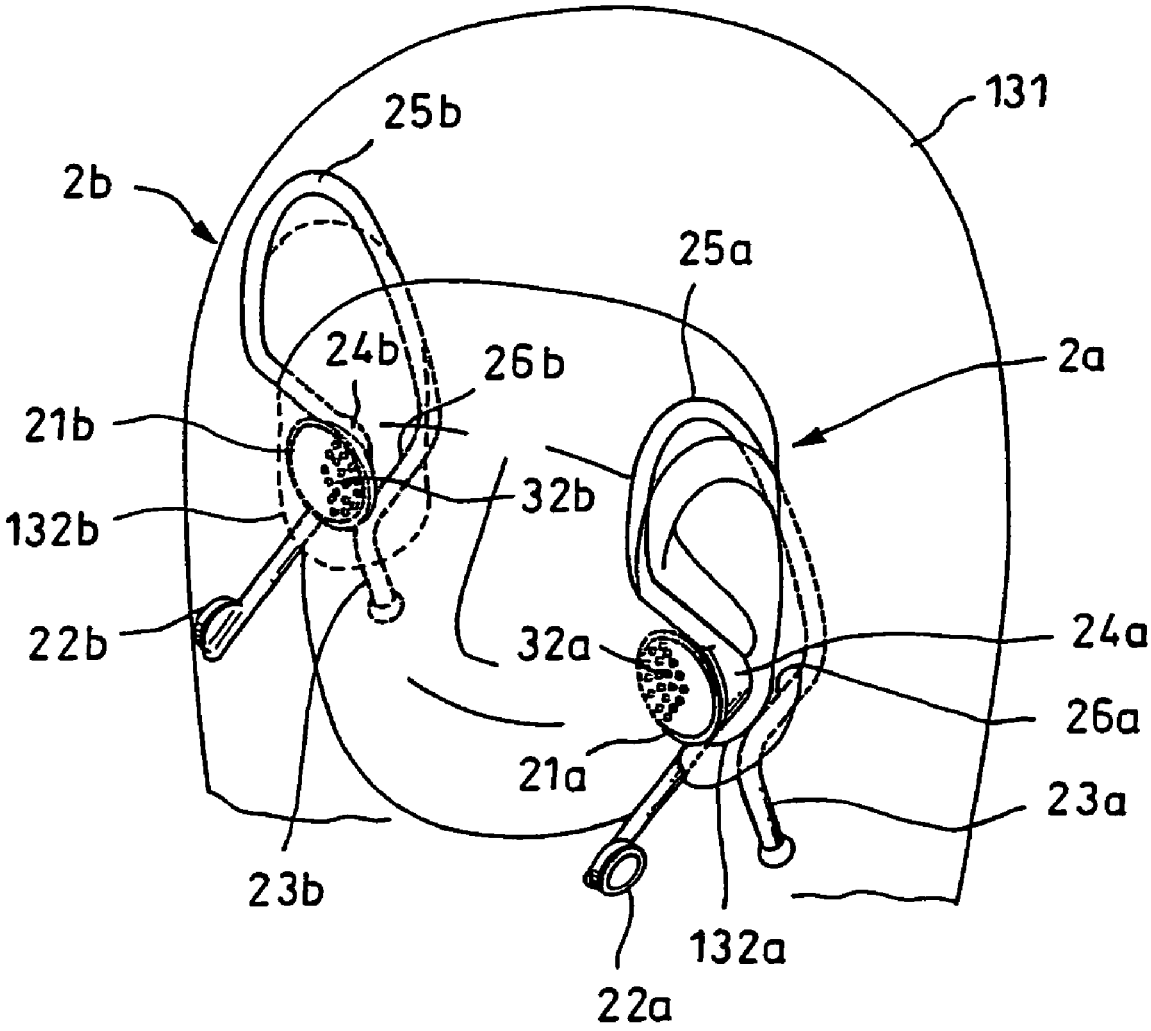
FIG. 14 is an explanatory view showing the state in which headphones according to an embodiment of the present invention are being worn on small-sized ears.

FIG. 14 is a view showing the state in which the headphones are being worn on small ears.

As shown in FIG. 14, in the state in which the left and right units 2*a* and 2*b* are being worn on small ears, the openings 32*a* and 32*b* of the semi-conical housing portions 21*a* and 21*b*, which are provided on the left front in the vicinity of one ends of the bends 25*a* and 25*b* of the arm-shaped guide portions 23*a* and 23*b* and conically supported by the supporting portions 24*a* and 24*b*, are accommodated in the earholes of the user 131's small ears 132*a* and 132*b*.

On this occasion, the approximately U-shaped bends 25*a* and 25*b* provided at the tops of the arm-shaped guide portions 23*a* and 23*b* are worn such that the bends have such space as can cover the upper ends of the auricles of the user 131's small ears 132*a* and 132*b*. On this occasion, the bends 25*a* and 25*b* are worn with the top ends protruding from the upper ends of the auricles of the user 131's small ears 132*a* and 132*b*.

Also, on this occasion, the pushing portions 26*a*and 26*b*, which are provided in the vicinity of the other ends of the bends 25*a* and 25*b* of the arm-shaped guide portions 23*a* and 23*b*, resiliently push from behind the auricles of the user 131's small ears 132*a* and 132*b* toward the conical supporting portions 24*a* and 24*b* of the housing portions 21*a* and 21*b* while being worn on the user 131.

On this occasion, the front sides of the earhole entrances of the user's small ears 132*a* and 132*b* are held by the portions between the conical supporting portions 24*a* and 24*b* of the housing portions 21*a* and 21*b*, and the handles 22*a* and 22*b*. Then, the pushing portions 26*a* and 26*b* are set on the backs of the auricles of the user's small ears 132*a* and 132*b*. In addition, the portions between the bends 25*a* and 25*b* of the arm-shaped guide portions 23*a* and 23*b*, and the pushing portions 26*a* and 26*b* thereof are set on the backs of the auricles of the user's small ears 132*a* and 132*b*.

Also, on this occasion, with respect to the arm-shaped guide portions 23*a* and 23*b*, the diaphragms within the housing portions 21*a* and 21*b* are disposed on the face side of the user wearing the arm-shaped guide portions 23*a* and 23*b* to be approximately perpendicular to the surfaces formed by the bends 25*a* and 25*b* of the arm-shaped guide portions 23*a* and 23*b*.

It is noted that an embodiment according to the present invention is not limited to the above described embodiment, and with respect to the arm-shaped guide portion, the handle and the end of the guide portion may be formed in the shape of a loop.

Figure 15:
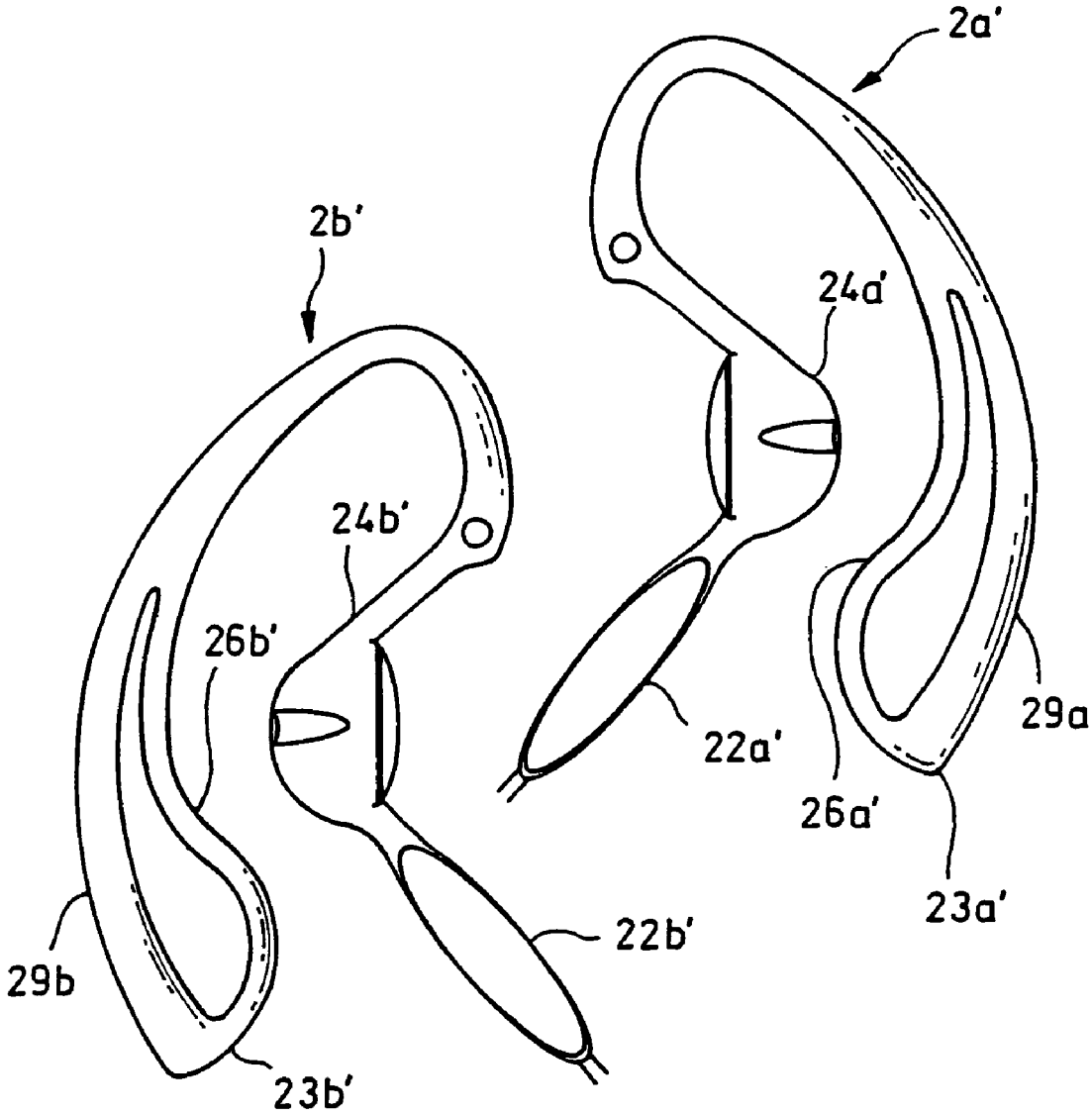
FIG. 15 is a side view showing an example of the external appearance of headphones according to another embodiment of the present invention.

For example, the headphones can be composed of left and right units 2*a*' and 2*b*' shaped as shown in FIG. 15. In this embodiment, supporting portions 24*a*' and 24*b*' are provided in the units 2*a*' and 2*b*' respectively, and after arm-shaped guide portions of the units 2*a*' and 2*b*' are bent to be approximately U-shaped as in the above-mentioned embodiment, pushing portions 26*a*' and 26*b*' and guide portions 23*a*' and 23*b*' are provided at the ends of the arm-shaped guide portions. Further, the guide portions 23*a*' and 23*b*' are bent to provide loop portions 29*a* and 29*b* which are connected to the middle of the arm-shaped guide portions. In addition, handles 22*a*' and 22*b*' are constructed to be thicker in shape to be held easily by the user than in the above-mentioned embodiment. The same effectiveness as that mentioned in the above embodiment can also be obtained from the construction shown in FIG. 15.

INDUSTRIAL APPLICABILITY

According to the headphones of the present invention, a user can easily accommodate the housing portions in the earholes of his/her ears as the guide portions being slipped along the bases of his/her ears, and at that time, since the pushing portions resiliently push from behind his/her auricles, the headphones can be reliably worn; moreover, since the sound-outputting surfaces are vertically disposed and most of the sound from the diaphragms reaches his/her eardrums directly, excellent sound quality is obtained as relatively unaffected by the shapes of an auditory meatus and the periphery of an entrance thereof that vary from person to person, and also the headphones can be worn without being affected by the sizes of auricles, with the result that the headphones can be comfortably worn by the user and quality of sound to be listened to can be improved.

The invention claimed is:

1. In a headphone provided with a housing portion including an electro-acoustic transducer therein and an arm-shaped guide portion supporting said housing portion, the headphone characterized in that:

said arm-shaped guide portion has an approximately U-shaped bend, a supporting portion which is provided in the vicinity of one end of said bend and supports said housing portion, a projecting handle that extends from said supporting portion, and a pushing portion which is provided in the vicinity of the other end of said bend and resiliently pushes from behind the auricle of a listener toward said housing portion; and, a sound-outputting surface of said housing portion is disposed on the face side of a listener wearing the headphone to be approximately perpendicular to a plane transected by an entire the bend of said arm-shaped guide portion;

wherein the housing portion is constructed and arranged to be accommodated in an earhole of the listener.

2. A headphone according to claim 1, wherein a cord which supplies electric signals to said electro-acoustic transducer is adapted to be pulled out from an end of said handle so that the portion of the cord that is pulled out it is external to the handle.

3. A headphone according to claim 1, wherein a cord which supplies electric signals to said electro-acoustic transducer is adapted to be pulled out from said handle, and wherein a cord stopper is provided in said handle.

4. In a headphone provided with a housing portion including an electro-acoustic transducer therein and an arm-shaped guide portion supporting said housing portion, the headphone characterized in that:

said arm-shaped guide portion has an approximately U-shaped bend, a supporting portion which is provided in the vicinity of one end of said bend and supports said housing portion, a projecting handle that extends from said supporting portion, and a pushing portion which is provided in the vicinity of the other end of said bend and resiliently pushes from behind the auricle of a listener toward said housing portion, and wherein a curved guide portion extends from the pushing portion; and a sound-outputting surface of said housing portion is disposed on the face side of a listener wearing the headphone to be approximately perpendicular to a plane transected by an entire the bend of said arm-shaped guide portion;

wherein the housing portion is constructed and arranged to be accommodated in an earhole of the listener.

5. A headphone according to claims 1 or 4, wherein a diaphragm included in the electro-acoustic transducer within said housing portion is also disposed to be approximately perpendicular to the surface formed by the bend of said arm-shaped guide portion, and sound emitted by the vibration of the diaphragm is output from said sound outputting surface.

6. A headphone according to claims 1 or 4, wherein the projecting handle is approximately linear and is disposed at a predetermined angle with respect to an extended axis of said arm-shaped guide portion.

7. A headphone according to claims 1 or 4, wherein the center of said housing portion is deviated from the axis of said arm-shaped guide portion so that said housing portion is asymmetrical.

8. A headphone according to claims 1 or 4, wherein the center of said housing portion is placed on the axis of said arm-shaped guide portion so that said housing portion is symmetrical.

9. A headphone according to claims 1 or 4, wherein openings of said housing portion which emit sound from the sound-outputting surface are provided only at the positions close to the earhole of the listener wearing the headphone and no other openings for emitting sound are provided at positions away from the earhole on said sound-outputting surface.

10. A headphone according to claims 1 or 4, wherein said arm-shaped guide portion and said housing portion are integrally formed.

* * * * *